US009835003B2

(12) United States Patent
Harris et al.

(10) Patent No.: US 9,835,003 B2
(45) Date of Patent: Dec. 5, 2017

(54) FRAC PLUG

(71) Applicant: Tercel Oilfield Products USA LLC

(72) Inventors: Michael J. Harris, Houston, TX (US); Kenneth J. Anton, Brenham, TX (US)

( * ) Notice: Subject to any disclaimer, the term of this patent is extended or adjusted under 35 U.S.C. 154(b) by 0 days.

(21) Appl. No.: 15/414,378

(22) Filed: Jan. 24, 2017

(65) Prior Publication Data

US 2017/0130553 A1 May 11, 2017

Related U.S. Application Data

(63) Continuation-in-part of application No. 15/055,696, filed on Feb. 29, 2016.

(60) Provisional application No. 62/149,553, filed on Apr. 18, 2015.

(51) Int. Cl.

| | |
|---|---|
| ***E21B 23/01*** | (2006.01) |
| ***E21B 33/12*** | (2006.01) |
| ***E21B 33/129*** | (2006.01) |
| ***E21B 43/26*** | (2006.01) |

(52) U.S. Cl.

CPC ..... *E21B 23/01* (2013.01); *E21B 33/1208* (2013.01); *E21B 33/1291* (2013.01); *E21B 43/26* (2013.01)

(58) Field of Classification Search

CPC .... E21B 33/12; E21B 33/1265; E21B 33/128; E21B 33/129; E21B 33/1291; E21B 33/1293; E21B 23/01

See application file for complete search history.

(56) References Cited

U.S. PATENT DOCUMENTS

| | | | |
|---|---|---|---|
| 4,901,794 | A | 2/1990 | Baugh et al. |
| 5,058,672 | A | 10/1991 | Cochran |
| 5,058,684 | A | 10/1991 | Winslow et al. |
| 5,271,468 | A | 12/1993 | Streich et al. |
| 5,511,620 | A | 4/1996 | Baugh et al. |
| 5,984,007 | A | 11/1999 | Yuan et al. |
| 6,220,349 | B1 | 4/2001 | Vargus et al. |

(Continued)

FOREIGN PATENT DOCUMENTS

EP 1712729 A2 10/2006

OTHER PUBLICATIONS

American Completion Tools, *Hydraulic Setting Tool* p. 19 (undated).

(Continued)

*Primary Examiner* — Brad Harcourt
(74) *Attorney, Agent, or Firm* — Keith B. Willhelm

(57) ABSTRACT

A plug apparatus comprises a wedge, a sealing ring, and a slip. The wedge comprises an axial wedge bore. A seat is defined in the wedge bore. The seat is adapted to receive a ball. The wedge has a tapered outer surface which decreases in diameter from the upper to the lower extent of the tapered outer surface. The sealing ring is received around the tapered outer surface of the wedge. The sealing ring has an axial ring bore and is radially expandable. The slip comprises an axial slip bore having a tapered inner surface. The tapered inner surface decreases in diameter from the upper to the lower extent of the tapered inner surface. The inner surface is adapted to receive the wedge. The wedge is adapted for displacement from an unset position generally above the slip to a set position wherein the wedge is received in the slip bore.

38 Claims, 15 Drawing Sheets

(56) References Cited

U.S. PATENT DOCUMENTS

| | | | | |
|---|---|---|---|---|
| 6,394,180 | B1 | 5/2002 | Berscheidt et al. | |
| 6,491,116 | B2 | 12/2002 | Berscheidt et al. | |
| 7,475,736 | B2 | 1/2009 | Lehr et al. | |
| 7,600,572 | B2 | 10/2009 | Slup et al. | |
| 7,740,079 | B2 | 6/2010 | Clayton et al. | |
| 7,789,137 | B2 | 9/2010 | Turley et al. | |
| 8,047,280 | B2 | 11/2011 | Tran et al. | |
| 8,336,616 | B1 | 12/2012 | McClinton | |
| 8,469,088 | B2 | 6/2013 | Shkurti et al. | |
| 8,579,024 | B2 | 11/2013 | Mailand et al. | |
| 8,887,818 | B1 | 11/2014 | Carr et al. | |
| 8,950,504 | B2 | 2/2015 | Xu et al. | |
| 8,955,605 | B2 | 2/2015 | VanLue | |
| 8,985,228 | B2 | 3/2015 | Xu et al. | |
| 8,997,853 | B2 | 4/2015 | VanLue | |
| 9,010,411 | B1 | 4/2015 | VanLue | |
| 9,010,416 | B2 | 4/2015 | Xu et al. | |
| 9,033,060 | B2 | 5/2015 | Xu et al. | |
| 9,074,439 | B2 | 7/2015 | VanLue | |
| 9,080,403 | B2 | 7/2015 | Xu et al. | |
| 9,080,416 | B2 | 7/2015 | Xu et al. | |
| 9,080,439 | B2 | 7/2015 | O'Malley et al. | |
| 9,097,095 | B2 | 8/2015 | VanLue | |
| 9,103,177 | B2 | 8/2015 | VanLue | |
| 9,121,247 | B2 | 9/2015 | George et al. | |
| 9,121,252 | B2 | 9/2015 | George et al. | |
| 9,273,526 | B2 | 3/2016 | Oberg et al. | |
| 9,284,803 | B2 | 3/2016 | Stone et al. | |
| 9,309,733 | B2 | 4/2016 | Xu et al. | |
| 9,316,086 | B2 | 4/2016 | VanLue | |
| 9,574,415 | B2 | 2/2017 | Xu et al. | |
| 2002/0121379 | A1 | 9/2002 | Doane | |
| 2008/0191420 | A1 | 8/2008 | Imhoff et al. | |
| 2010/0181761 | A1* | 7/2010 | Santi | E21B 17/042 285/332.2 |
| 2010/0276159 | A1* | 11/2010 | Mailand | E21B 33/134 166/382 |
| 2013/0186649 | A1* | 7/2013 | Xu | E21B 23/01 166/382 |
| 2014/0209325 | A1 | 7/2014 | Dockweiler et al. | |
| 2014/0227024 | A1 | 8/2014 | Gilling | |
| 2015/0068729 | A1 | 3/2015 | Carr et al. | |
| 2015/0129239 | A1 | 5/2015 | Richard | |
| 2015/0300121 | A1 | 10/2015 | Xu | |
| 2016/0145964 | A1 | 5/2016 | Doane et al. | |
| 2016/0186511 | A1 | 6/2016 | Coronado et al. | |

OTHER PUBLICATIONS

American Completion Tools, *Model Fury 05 Hydraulic Setting Tool Operation Procedure* pp. 50-52 (undated).
Baker Hughes, *E-4 Wireline Pressure Setting Assembly and Baker Hughes C Firing Heads* (© 2012-2014).
Baker Hughes, *Model E-4™ Wireline Pressure Setting Assemblies* (© 2014).
Baker Hughes *SHADOW Seriers Frac Plug* (© 2014).
Evonik Industries, *CAMPUS® Datasheet—VESTKEEP® L 4000 G-PEEK* (Aug. 25, 2016).
Evonik Industries, *Product Information—VESTAKEEP® L4000G High-Viscosity, Unreinforced Polyether Ether Ketone* (Oct. 2011).
Evonik Industries, *VESTAKEEP® PEEK—Polyether Ether Ketone Compounds* (undated).
Evonik Industries, *VESTAKEEP® PEEK Offers the Strongest Bonding Strength to Withstand Strict Operating Environmental Conditions* (Oct. 27, 2014).
Geodynamics, *FracDock™ Intervention-free Frac Plug System—Frac It and Forget it* (© 2015).
Geodynamics, *SmartStart PLUS™* (undated).
Halliburton, *Fas Drill® Bridge Plug* (© 2014).
Halliburton, *Halliburton 250-Series Frac Plugs* (© 2012).
Halliburton, *Wireline Setting Tools* (© 2015).
High Pressure in Integrity, Inc., *Direct Pump Setting Tool DPST—Chapter 6* (© 2008 Weatherford).
Kipo, PCT International Search Report, Ser. No. PCT/US2016/026349 dated (Jul. 1, 2016).
Owen Oil Tool *Big Bore Frac Plug* (© 2002).
Peak Completions, *Set-a-Seat™ Pump-Down Casing Baffle* (© 2014-2015).
Schlumberger, *Copperhead Big Bore Flow-Through Frac Plug* (© 2014).
Schlumberger, *Diamondback Composite Drillable Frac Plug* (© 2016).
Schlumberger, *Model E Hydraulic Setting Tool* (© 2014).
Superior Energy Services, *OmniFrac™ Systems* (undated).
Tam International, *PosiFrac HALO™—Large Bore Fracture Seat* (2016).
Unknown, *Baker Style #20 Setting Tool* (undated).
Weatherford, *TruFrac® Composite Frac Plug—Optimizing Costs in Plug-and-Peri Operations* (undated).
Weatherford, *TruFrac® Composite Frac Plug* (© 2015).
Baker Hughes Inc., *Torpedo Composite Frac Plug—Overview* (Copyright 2017).
Downhole Technology LLC, *Boss Hog Features at a Glance*, www.downholetechnology.com/features-benefits/boss-hog-at-a-glance (Jun. 5, 2017).
European Patent Office, Invitation to Pay Additional Fees and, Where Applicable, Protest Fee, dated May 10, 2017.
Halliburton, *Obsidian® Frac Plug* (Copyright 2015).
Magnum Oil Tools Int'l , *Composite Frac Plugs—Magnum Series* (May 16, 2017).
Nine Energy Service, *Scorpion High-Quality, Pliny Composite Plugs* (undated).
Schlumberger, *Diamondback Composite Drillable Frac Plug* (Copyright 2016).
Weatherford, *TruFrac® Composite Frac Plug* (undated).

* cited by examiner

FRAC PLUG

CLAIM TO PRIORITY

This application is a continuation-in-part of a non-provisional patent application entitled "Frac Plug", U.S. Ser. No. 15/055,696, filed Feb. 29, 2016, which claims priority of a provisional patent application entitled "Frac Plug", U.S. Ser. No. 62/149,553, filed Apr. 18, 2015, the disclosure and drawings of which applications are incorporated herein in their entirety by reference.

FIELD OF THE INVENTION

The present invention relates generally to plugs that may be used to isolate a portion of a well, and more particularly, to plugs that may be used in fracturing or other processes for stimulating oil and gas wells.

BACKGROUND OF THE INVENTION

Hydrocarbons, such as oil and gas, may be recovered from various types of subsurface geological formations. The formations typically consist of a porous layer, such as limestone and sands, overlaid by a nonporous layer. Hydrocarbons cannot rise through the nonporous layer, and thus, the porous layer forms an area or reservoir in which hydrocarbons are able to collect. A well is drilled through the earth until the hydrocarbon bearing formation is reached. Hydrocarbons then are able to flow from the porous formation into the well.

In what is perhaps the most basic form of rotary drilling methods, a drill bit is attached to a series of pipe sections referred to as a drill string. The drill string is suspended from a derrick and rotated by a motor in the derrick. A drilling fluid or "mud" is pumped down the drill string, through the bit, and into the well bore. This fluid serves to lubricate the bit and carry cuttings from the drilling process back to the surface. As the drilling progresses downward, the drill string is extended by adding more pipe sections.

When the drill bit has reached the desired depth, larger diameter pipes, or casings, are placed in the well and cemented in place to prevent the sides of the borehole from caving in. Cement is introduced through a work string. As it flows out the bottom of the work string, fluids already in the well, so-called "returns," are displaced up the annulus between the casing and the borehole and are collected at the surface.

Once the casing is cemented in place, it is perforated at the level of the oil bearing formation to create openings through which oil can enter the cased well. Production tubing, valves, and other equipment are installed in the well so that the hydrocarbons may flow in a controlled manner from the formation, into the cased well bore, and through the production tubing up to the surface for storage or transport.

This simplified drilling and completion process, however, is rarely possible in the real world. Hydrocarbon bearing formations may be quite deep or otherwise difficult to access. Thus, many wells today are drilled in stages. An initial section is drilled, cased, and cemented. Drilling then proceeds with a somewhat smaller well bore which is lined with somewhat smaller casings or "liners." The liner is suspended from the original or "host" casing by an anchor or "hanger." A seal also is typically established between the liner and the casing and, like the original casing, the liner is cemented in the well. That process then may be repeated to further extend the well and install additional liners. In essence, then, a modern oil well typically includes a number of tubes telescoped wholly or partially within other tubes.

Moreover, hydrocarbons are not always able to flow easily from a formation to a well. Some subsurface formations, such as sandstone, are very porous. Hydrocarbons are able to flow easily from the formation into a well. Other formations, however, such as shale rock, limestone, and coal beds, are only minimally porous. The formation may contain large quantities of hydrocarbons, but production through a conventional well may not be commercially practical because hydrocarbons flow though the formation and collect in the well at very low rates. The industry, therefore, relies on various techniques for improving the well and stimulating production from formations. In particular, various techniques are available for increasing production from formations which are relatively nonporous.

One technique involves drilling a well in a more or less horizontal direction, so that the borehole extends along a formation instead of passing through it. More of the formation is exposed to the borehole, and the average distance hydrocarbons must flow to reach the well is decreased. Another technique involves creating fractures in a formation which will allow hydrocarbons to flow more easily. Indeed, the combination of horizontal drilling and fracturing, or "frac'ing" or "fracking" as it is known in the industry, is presently the only commercially viable way of producing natural gas from the vast majority of North American gas reserves.

Fracturing a formation is accomplished by pumping fluid, most commonly water, into the well at high pressure and flow rates. The fluid is injected into the formation, fracturing it and creating flow paths to the well. Proppants, such as grains of sand, ceramic or other particulates, usually are added to the frac fluid and are carried into the fractures. The proppant serves to prevent fractures from closing when pumping is stopped.

Fracturing typically involves installing a production liner in the portion of the well bore which passes through the hydrocarbon bearing formation. The production liner may incorporate valves, typically sliding sleeve valves, which may be actuated to open ports in the valve. The valves also incorporate a plug. The plug restricts flow through the liner and diverts it through the valve ports and into the formation. Once fracturing is complete various operations will be performed to "unplug" the valve and allow fluids from the formation to enter the liner and travel to the surface.

In many wells, however, the production liner does not incorporate valves. Instead, fracturing will be accomplished by "plugging and perfing" the liner. In a "plug and perf" job, the production liner is made up from standard lengths of liner. The liner does not have any openings through its sidewalk, nor does it incorporate frac valves. It is installed in the well bore, and holes then are punched in the liner walls. The perforations typically are created by so-called "perf" guns which discharge shaped charges through the liner and, if present, adjacent cement.

A plug and perf operation can allow a well to be fractured at many different locations, but rarely, if ever, will the well be fractured all at once. The liner typically will be perforated first in a zone near the bottom of the well. Fluids then are pumped into the well to fracture the formation in the vicinity of the bottom perforations.

After the initial zone is fractured, a plug is installed in the liner at a point above the fractured zone. The liner is perforated again, this time in a second zone located above the plug. A ball then is deployed onto the plug. The ball will restrict fluids from flowing through and past the plug. When fluids are injected into the liner, therefore, they will be forced to flow out the perforations and into the second zone. After the second zone is fractured, the process is repeated until all zones in the well are fractured.

After the well has been fractured, however, plugs may interfere with installation of production equipment in the liner or may restrict the flow of production fluids upward through the liner. Thus, the plugs typically are removed from the liner after the well has been fractured. Retrievable plugs are designed to be set and then unset. Once unset, they may be removed from the well. Non-retrievable plugs are designed to be more or less permanently installed in the liner. Once installed, they must be drilled out to open up the liner. Moreover, the debris created by drilling out non-retrievable plugs must be circulated out of the well so it does not interfere with production equipment that will be installed in the liner.

Many conventional non-retrievable plugs have a common basic design built around a central support mandrel. The support mandrel is generally cylindrical and somewhat elongated. It has a central conduit extending axially through it. The support mandrel serves as a core for the plug and provides support for the other plug components. The other plug components—slips, wedges, and sealing elements—are all generally annular and are carried on and around the support mandrel in an array extending along the length of the mandrel.

More particularly, an upper set of slips is carried on the support mandrel adjacent to an upper wedge (also referred to as a "cone"). A lower set of slips is disposed adjacent to a lower wedge. The slips and wedges have mating, ramped surfaces. An annular sealing element, usually an elastomeric sealing element, is carried on the support mandrel between the upper and lower wedges. The sealing element often is provided with backup rings. The various components are carried on the support mandrel such that they may slide along the mandrel.

Such conventional frac plugs have nominal outer diameters in their "unset" position that allow them to be deployed into a liner. Once deployed, they will be set by radially expanding the slips and sealing element into contact with the liner walls. More specifically, the plugs are installed with a setting tool which may be actuated to apply opposing axial forces to the components carried around the plug support mandrel. The axial forces cause the components to slide axially along the support mandrel and squeeze together. As they are squeezed together, the ramped surfaces on the inside of the slips will cause the slips to ride up the ramped outer surface of the wedges. As they ride up the outer surface of the wedges, the slips expand radially until they contact the inner wall of the liner. The outer surfaces of the slips have teeth, serrations, and the like that enable the slips to jam and bite into the liner wall. The slips, therefore, provide the primary anchor which holds the plug in place.

Squeezing the components also will cause the elastomeric sealing element to expand radially until it seals against the liner wall. Backup rings, if present, serve to minimize axial extrusion of the elastomeric material as it is squeezed between the upper and lower wedges. The elastomeric sealing element thus can minimize or eliminate flow around the plug, i.e., between the plug and the liner wall.

The support mandrel has a ball seat at or very near the upper end of the mandrel central conduit. Once the plug is installed, and the setting tool withdrawn, fluids can flow in both directions through the central conduit. A ball may be deployed or "dropped" onto the ball seat, however, to substantially isolate the portions of the liner below the plug. The ball will restrict fluid from flowing downward through the plug.

Such designs are well known in the art and variations thereof are disclosed, for example, in U.S. Pat. No. 7,475,736 to D. Lehr et U.S. Pat. No. 7,789,137 to R. Turley et al., U.S. Pat. No. 8,047,280 to L. Tran et al., and U.S. Pat. No. 9,316,086 to D. VanLue. Plugs of that general design also are commercially available, such as Schlumberger's Diamondback composite drillable frac plug and Weatherford's TruFrac composite frac plug.

Frac plugs must resist very high hydraulic pressure—often as high as 15,000 psi or more. They also may be exposed to elevated temperatures and corrosive liquids. Thus, frac plugs traditionally were composed of relatively durable materials such as steel. Frac plugs fabricated with metal components have greater structural strength that may in turn facilitate installation of the plug. Metal components also may be less likely to loosen up and become unset, and they are more resistant to corrosion. On the other hand, the required service life of frac plugs may be relatively short, and metallic plugs are difficult to drill out.

Thus, some or all of the components of many conventional non-retrievable frac plugs now are fabricated from more easily drillable materials. Such materials include cast iron, aluminum, and other more brittle or softer metals. Other more easily drillable materials include fiberglass, carbon fiber materials, and other composite materials. Composite materials in particular are more easily drilled and, therefore, can make it easier to drill out a plug. They also can allow for less aggressive drilling and reduce the likelihood and amount of resulting damage to a liner.

It will be appreciated, however, that the central conduit of many conventional composite plugs has a relatively small diameter. Smaller diameter bores make it more likely that the plug will significantly restrict the flow of production fluids through the plug, or that it will not accommodate the passage of other tools that may be needed for remedial operations. Thus, there is a greater likelihood with small-bore plugs that the plugs will have to be drilled out.

Even with composite plugs, drill out operations can be costly and time consuming. Coil tubing drill outs typically cost $100,000.00 per day, and the process may take two to three days. Moreover, a plug and perf frac job may require the installation of dozens of plugs. Thus, even a small increase in the time required to drill an individual plug may considerably lengthen the overall cost and time required for the operation.

It also will be appreciated that composite materials lack the hardness and strength of metals such as steel, cast iron, and aluminum. Plugs fabricated from composite materials may not hold their set or seal. They may be dislodged, damaged, or leak during the fracturing process as composite materials generally lack the yield strength of metals. Composites also have much lower lateral shear strengths, and thus, are more susceptible to being blown out by a ball once hydraulic pressure above the ball is increased. Such deficiencies often are minimized by increasing the length and thickness of the plug components.

For example, making a support mandrel thicker will increase its radial yield strength and will help maintain the engagement of the slips with a liner wall. A longer support mandrel will have a proportionately higher lateral shear strength and, therefore, is better able to resist the force of a ball seated in the mandrel passageway. Increasing the size of the components, however, necessarily increases the time required to drill the plug and increased the amount of debris that must be circulated out of the well.

Additionally, while many of their components are fabricated from composites, many so-called composite plugs may still incorporate metal components which can slow down or complicate drilling out of the plug. For example, many predominantly composite plugs incorporate metallic slips which increase the time required to drill out the plug. Metal slips also can break up into relatively large pieces that may be more difficult to circulate out of a well.

Also, as noted, the elastomeric sealing element in many conventional plugs is disposed initially between the upper and lower wedges. As the wedges are squeezed together, the elastomeric sealing element is expanded radially. There also will be a tendency, however, for the elastomeric materials to extrude axially over and around the surface of the wedges. When hydraulic pressure later is applied behind the plug, it also may tend to extrude the elastomeric seal. Thus, many composite plugs incorporate metal or composite rings to back up the elastomeric seal. Such backup rings are not always effective in preventing extrusion. Metal rings especially can become entangled around the bit used to drill the plug.

The process of drilling out plugs also can be exacerbated by what is referred to as "spinning." That is, as a plug is drilled out, the portions of the plug components remaining after most of the plug has been drilled out tend to spin with the bit. Given their relatively lower mechanical properties, spinning is a particular problem in composite plugs and can significantly increase the time required to drill out a plugs. A common solution is to provide interlocking mechanical features on the top and bottom of the plugs. Thus, if the remnant of a plug begins to spin with a bit, it will be pushed down by the bit until its lower end interlocks with the top of a plug installed lower down in the liner. That interlocking engagement will stop the plug remnant from spinning. Such interlocking geometrical features, however, can add length and material to the plug.

Finally, as various problems attendant to their installation and drilling out have been addressed, composite plugs have tended to become relatively complex. Composite materials in general can be relatively expensive, and adding to the complexity and number of components in a plug generally tends to increase the cost of fabricating and assembling the plug. Typical plug and perf jobs will require dozens of plugs, so even small increases in the cost of a plug can add up to a significant expense.

The statements in this section are intended to provide background information related to the invention disclosed and claimed herein. Such information may or may not constitute prior art. It will be appreciated from the foregoing, however, that there remains a need for new and improved composite plugs and for new and improved methods for fracking or otherwise stimulating formations using composite plugs. Such disadvantages and others inherent in the prior art are addressed by various aspects and embodiments of the subject invention.

SUMMARY OF THE INVENTION

The subject invention relates generally to plugs that may be used to isolate a portion of a well and encompasses various embodiments and aspects, some of which are specifically described and illustrated herein.

In one embodiment, a plug apparatus includes an annular wedge having a wedge first end and a wedge second end. The wedge includes an axial wedge passage therethrough from the wedge first end to the wedge second end. The wedge includes an inner seat defined in the wedge passage for receiving and seating a ball. The wedge has a tapered outer surface adjacent the wedge second end. The tapered outer surface increases in outside diameter from the wedge second end toward but not necessarily all the way to the wedge first end. A sealing ring is received about the tapered outer surface of the wedge. The sealing ring is radially expandable. An annular slip has a slip first end and a slip second end. The slip has an axial slip passage therethrough from the slip first end to the slip second end. The slip passage has a tapered inner surface adjacent the slip first end. The tapered inner surface decreases in inside diameter from the slip first end toward but not necessarily all the way to the slip second end. The wedge second end is received in the slip first end so that the tapered outer surface of the wedge engages the tapered inner surface of the slip. The slip first end faces the sealing ring for abutment with the sealing ring.

The annular slip can include a plurality of separate slip segments. The annular wedge can also include a plurality of collet fingers extending from the wedge second end and circumferentially spaced to form slots between the collet fingers, each collet finger extending through the axial slip passage to a distal end beyond the slip second end. The plug apparatus can further include a setting ring having an outer diameter, slidably mounted around the collet fingers between the slip second end and the distal end of each collet finger. The setting ring can have a first radial thickness and one or more keys that protrude radially inward into one or more of the slots from the first radial thickness to a second radial thickness. The plug apparatus can further include a gauge ring fixably connected to the distal end of the collet fingers having an outer diameter at least the same as the outer diameter of the setting ring or greater. As an alternative option, the setting ring can be located adjacent to the gauge ring and to the slip second end, and the gauge ring can include a peripheral annular wall that extends around the setting ring and extends at least to the slip second end.

According to one aspect, the setting ring is slidable between an unset position and a set position. In the unset position, the slip and the sealing ring are each in a first radial position wherein the setting ring is located adjacent to the gauge ring and to the slip second end. In the set position, the slip and the sealing ring are each radially expanded from the first radial position to a second radial position, wherein the setting ring is displaced along the collet fingers towards the wedge second end and the adjacent slip and sealing ring are correspondingly displaced towards the wedge first end.

The plug apparatus can yet further include a mandrel connected to a setting tool, the mandrel extending through the axial wedge passage and releasably coupled to the setting ring via a frangible coupling. The plug apparatus can still further include an annular sleeve adapter connected to the setting tool and coupled to the first wedge end of the annular wedge, wherein the setting tool is configured to displace the mandrel axially relative to the annular sleeve adapter and thereby move the setting ring from the unset position to the set position.

In an alternative embodiment, a plug apparatus comprises an annular slip formed from a plurality of separate slip segments disposed adjacently to one another. The slip has an upper end and a lower end, and a slip bore that extends from the slip's upper end to its lower end and is also inwardly tapered from the upper end toward the lower end. The plug apparatus further comprises a wedge with a tapered lower outer surface portion that is received in the upper end of the slip and engages the tapered slip bore. The wedge includes a wedge bore with an upwardly facing annular seat defined therein. A plurality of collet fingers, circumferentially spaced in an annular arrangement, extends axially from a lower end of the tapered lower outer surface portion of the wedge. Each collet finger extends through the slip bore to a distal end beyond the slip lower end. A setting ring is slidably located on the plurality of collet fingers between the slip lower end and the distal end of the collet fingers. The plug apparatus yet further comprises a sealing ring received about the tapered lower outer surface portion of the wedge above the slip upper end and is configured to be engaged by the slip upper end.

A method is disclosed for setting a plug in a casing bore, the method comprising initially retaining a wedge and a slip in an unset axially extended position with a lower tapered outer surface of the wedge received in an upper tapered inner bore of the slip. A sealing ring is received about the wedge above the slip and engaged with an upper end of the slip. While the wedge and the slip are retained in the unset position, the plug is run into a casing to a casing location to be plugged. The plug then is set in the casing by forcing the wedge axially into the slip and the sealing ring; thereby radially expanding the slip to anchor the plug in the casing, and radially expanding the sealing ring to seal between the plug and the casing.

In another embodiment, an adapter apparatus is provided for attaching a plug onto a downhole setting tool. The setting tool including an inner setting tool part and an outer setting tool part. The setting tool is configured to provide a relative longitudinal motion between the inner and outer setting tool parts. The adapter apparatus includes an outer adapter portion configured to be attached to the outer setting tool part, the outer adapter portion including downward facing setting surface. The adapter apparatus further includes an inner adapter portion configured to be attached to the inner setting tool part, the inner adapter portion including an inner mandrel, a release sleeve, and a releasable connector. The release sleeve is slidably received on the inner mandrel, the release sleeve carrying an upward facing setting surface. The releasable connector is configured to hold the release sleeve in an initial position relative to the inner mandrel until a compressive force transmitted between the downward facing setting surface and the upward facing setting surface exceeds a predetermined release value.

In another embodiment, an adapter apparatus is provided for attaching a plug onto a downhole setting tool. The setting tool including an inner setting tool part and an outer setting tool part. The setting tool is configured to provide a relative longitudinal motion between the inner and outer setting tool parts. The adapter apparatus includes an outer adapter portion configured to be attached to the outer setting tool part, the outer adapter portion including downward facing setting surface. The adapter apparatus further includes an inner adapter portion configured to be attached to the inner setting tool part, the inner adapter portion including an inner mandrel, a release sleeve, and a releasable connector. The release sleeve is slidably received on the inner mandrel, the release sleeve carrying an upward facing setting surface. The releasable connector is configured to hold the release sleeve in an initial position relative to the inner mandrel until a compressive force transmitted between the downward facing setting surface and the upward facing setting surface exceeds a predetermined release value.

A method is provided for setting a plug assembly in a casing bore. The method comprises connecting the plug assembly in an initial arrangement with a setting tool using an adapter kit. The initial arrangement includes the plug assembly including a plug wedge in an initial position partially received in a plug slip, with a sealing ring received around the plug wedge adjacent an end of the slip. The plug wedge and plug slip are received about an inner part of the adapter kit, with an upward facing setting surface of the inner part facing a lower end of the plug assembly. An outer part of the adapter kit including a downward facing setting surface facing an upper end of the plug assembly. The plug assembly, the adapter kit, and the setting tool is run into the casing bore in the initial arrangement. The plug assembly is set in the casing bore by actuating the setting tool and compressing the plug assembly between the upward facing and downward facing setting surfaces. The plug assembly is released from the adapter kit.

The subject invention provides other embodiments and aspects, including a plug apparatus, comprising a wedge, a sealing ring, and a slip. The wedge comprises an axial wedge bore. A seat is defined in the wedge bore. The seat is adapted to receive a ball. The wedge also has a tapered outer surface. The tapered outer surface decreases in diameter from the upper extent of the tapered outer surface toward the lower extent of the tapered outer surface. The sealing ring is received around the tapered outer surface of the wedge. The sealing ring has an axial ring bore and is radially expandable. The slip comprises an axial slip bore. The slip bore provides the slip with a tapered inner surface. The tapered inner surface decreases in diameter from the upper extent of the tapered inner surface toward the lower extent of the tapered inner surface. The inner surface is adapted to receive the wedge along the tapered outer surface of the wedge. The wedge is adapted for displacement from an unset position generally above the slip to a set position wherein the wedge is received in the slip bore along the tapered outer surface of the wedge.

Other embodiments include such plug apparatus where the sealing ring and the slip are adapted to expand radially from an unset condition. In the unset position the sealing ring and the slip have nominal outer diameters. The slip expands radially from its unset condition to a set condition as the wedge is displaced from its unset position to its set position. In its set condition, the sealing ring and the slip have enlarged outer diameters.

Additional aspects are directed to such plug assemblies where a lower portion of the tapered outer surface of the wedge, when the wedge is in its unset position, extends into and engages an upper portion of the tapered inner surface of the slip.

Still other embodiments are directed to such plug assemblies where the sealing ring includes an annular ring body. The annular ring body has a tapered ring bore complementary to the tapered outer surface of the wedge. An annular inner groove is defined in the ring bore. An annular outer groove is defined in the outer surface of the ring body. An inner elastomeric seal is received in the inner groove. An outer elastomeric seal is received in the outer groove.

Further aspects and embodiments are directed to such plug assemblies where the slip comprises a plurality of separate slip segments. Yet others are direct to such plug assemblies where the sealing ring is radially expandable without breaking and where the sealing ring includes an annular ring body constructed of a sufficiently ductile material such that the sealing ring can expand radially to its set condition without breaking.

The subject invention also is directed to embodiments where such plug assemblies have a sealing ring fabricated from plastic and especially from engineering plastics. In other embodiments the plastic is selected from plastics or engineering plastics selected from the group consisting of polycarbonates, polyamides, polyether ether ketones, and polyetherimides and copolymers and mixtures thereof or the groups consisting of subsets of such groups.

In other aspects and embodiments the sealing ring is fabricated from plastic and has a elongation factor of at least about 10% or at least about 30%. In other aspects, the plastic will have a useful operating temperature of at least 250° F. or at least 350° F., or will have a tensile strength of a least 5,000 psi or at least about 1,500 psi.

Still other embodiments include such plug apparatus where the ball seat is located in the wedge bore such that when the wedge is in its set position the ball seat is situated axially proximate to the sealing ring, or where the ball seat is located in the wedge bore axially below the upper end of the wedge bore, or where the ball seat is located in the wedge bore such that when the wedge is in its set position the ball seat is situated axially between the upper end of the sealing ring and the lower end of the slip, or where the ball seat is located in the wedge bore such that when the wedge is in its set position the ball seat is situated axially below the midpoint of the slip bore.

Additional aspects are directed to such plug assemblies where the ball seat is provided by an upward facing tapered reduction in the diameter of the wedge bore or where the tapered reduction in diameter is approximately 15° off center.

In other embodiments, such plug apparatus have wedges where the tapered outer surface of the wedge is a truncated, inverted cone and the tapered inner surface of the slip is a truncated, inverted cone. In other aspects, the tapered outer surface of the wedge and the tapered inner surface of the slip are provided with a taper from about 1° to about 10° off center or where the tapered outer surface of the wedge and the tapered inner surface of the slip provide a self-locking taper fit between the wedge and the slip.

Other embodiments of the invention are directed to such plug apparatus where the slip comprises a plurality of separate slip segments. Each of the slip segments are configured generally as lateral segments of an open cylinder. In other aspects, the slip segments are aligned axially. When the wedge is in its unset position, the slip segments circumferentially abut along their sides and provide a substantially continuous inner tapered surface of the slip. In still other aspects the upper end of the slip abuts the sealing ring about the lower end of the sealing ring as the wedge moves from its unset position to its set position. In other embodiments, the upper end of the slip, when the wedge is in its unset position, abuts the sealing ring substantially continuously about the lower end of the sealing ring.

Other embodiments and aspects of the invention are directed to plug apparatus comprising a wedge, a plastic sealing ring, and a slip. The wedge comprises an axial wedge bore and a tapered outer surface. The tapered outer surface decreases in diameter from the upper extent of the tapered outer surface toward the lower extent of the tapered outer surface. The plastic sealing ring is received around the tapered outer surface of the wedge. The sealing ring has an axial ring bore and is radially expandable. The slip comprises an axial slip bore. The slip bore provides the slip with a tapered inner surface. The tapered inner surface decreases in diameter from the upper extent of the tapered inner surface toward the lower extent of the tapered inner surface. The inner surface is adapted to receive the wedge along the tapered outer surface of the wedge. The wedge is adapted for displacement from an unset position generally above the slip to a set position wherein the wedge is received in the slip bore along the tapered outer surface of the wedge. Displacement of the wedge is adapted to radially expand the sealing ring into sealing engagement with a liner without breaking the sealing ring.

Additional aspects and embodiments are directed to such plug apparatus where the comprises a plurality of collet fingers. The collet fingers extend axially below the tapered outer surface of the wedge. They are circumferentially spaced to form axial slots between the collet fingers. They also extend through the slip bore to a distal end beyond the slip when the wedge is in the unset position.

In other embodiments, such plug apparatus have a setting ring slidably mounted around the collet fingers between the slip and the distal end of the collet fingers. The setting ring has an outer diameter, a first radial thickness; and one or more keys that protrude radially inward from the first radial thickness to a second radial thickness and into one or more of the slots between the collet fingers.

Further embodiments are directed to such plug apparatus having a gauge ring connected to the distal end of the collet fingers and having an outer diameter equal to or greater than the outer diameter of the setting ring. In other embodiments, the setting ring is between the slip and a lower portion of the gauge ring and the gauge ring includes a peripheral annular wall that extends axially upward around the setting ring and at least of portion of the slip.

Yet other embodiments are directed to plug apparatus where the wedge is adapted for displacement from the unset position to the set position. In the unset position the slip and the sealing ring are each in a first radial position and the setting ring is located adjacent to the gauge ring and to the slip. In the set position, the slip and the sealing ring are each radially expanded from the first radial position to a second radial position and the setting ring is located adjacent to the slip and the distal ends of the collet fingers are displaced away from the setting ring.

Additional aspects and embodiments are directed to such plug apparatus which have a mandrel and a sleeve adapter. The mandrel is operably connected to a setting tool and extends through the wedge bore and releasably coupled to the setting ring by a frangible coupling. The sleeve adapter is operably connected to the setting tool and abuts the upper end of the wedge. The setting tool is configured to displace the sleeve adapter axially downward relative to the mandrel and thereby displace the wedge from the unset position to the set position.

In other aspects, the invention is directed to such plug assemblies as a composed of drillable materials, including composite materials, and especially where the wedge and slip are fabricated from such materials.

The subject invention in other aspects and embodiments also provides for methods of setting a plug in a liner bore. The methods comprise running the plug into the liner to a location to be plugged. The plug is in an unset state in which a tapered outer surface of a wedge is generally above a tapered inner bore of a slip. A sealing ring is received around the tapered outer surface of the wedge above the slip. The plug then is set in the liner by forcing the wedge axially into the slip bore and the sealing ring. Thus, the slip will be radially expanded to anchor the plug in the liner, and the sealing ring will be radially expanded to seal between the plug and the liner.

Other aspects provide such methods where the sealing ring expands radially without breaking. In other embodiments, the slip abuts the sealing ring as the wedge is forced into the slip bore and sealing ring. In yet other embodiments the slip, when the plug is in its unset state, abuts the sealing ring substantially continuously about the sealing ring. Other embodiments include deploying a ball onto an annular seat defined in an axial bore of the wedge to occlude the axial bore.

Still other aspects of the invention are directed to liner assemblies which comprise a liner with the novel plug assemblies set therein and to oil and gas wells incorporating such liner assemblies.

Finally, still other aspect and embodiments of the novel apparatus and methods will have various combinations of such features as will be apparent to workers in the art.

Thus, the present invention in its various aspects and embodiments comprises a combination of features and characteristics that are directed to overcoming various shortcomings of the prior art. The various features and characteristics described above, as well as other features and characteristics, will be readily apparent to those skilled in the art upon reading the following detailed description of the preferred embodiments and by reference to the appended drawings.

Since the description and drawings that follow are directed to particular embodiments, however, they shall not be understood as limiting the scope of the invention. They are included to provide a better understanding of the invention and the manner in which it may be practiced. The subject invention encompasses other embodiments consistent with the claims set forth herein.

BRIEF DESCRIPTION OF THE DRAWINGS

FIG. 2 shows plug 16 in its run-in state, that is, as it is run into a well to a desired location in liner 4.

FIG. 3 shows plug 16 after it has been installed in liner 4.

FIG. 4 shows plug 16 after it has been closed with a ball 76 to restrict the flow of fluids downward through plug 16.

FIG. 9A shows an upper portion of tool string 10, and FIG. 9B shows a lower portion of tool string 10.

FIG. 13 shows adapter kit 14 and plug 16 after they have been actuated from their run-in state shown in FIG. 11 to install plug 16 in liner 4.

FIG. 14 shows an initial stage of releasing and withdrawing adapter kit 14 from set plug 16.

FIG. 15 shows an intermediate stage of releasing and withdrawing adapter kit 14 from set plug 16.

FIG. 16 shows a later stage of releasing and withdrawing adapter kit 14.

FIG. 23 shows plug 216 in an unset position as it is run into a well to a desired location in liner 4.

FIG. 24 shows plug 216 after it has been set in liner 4 and it has been closed with a ball 76 to restrict the flow of fluids downward through plug 216.

Figure 1A:
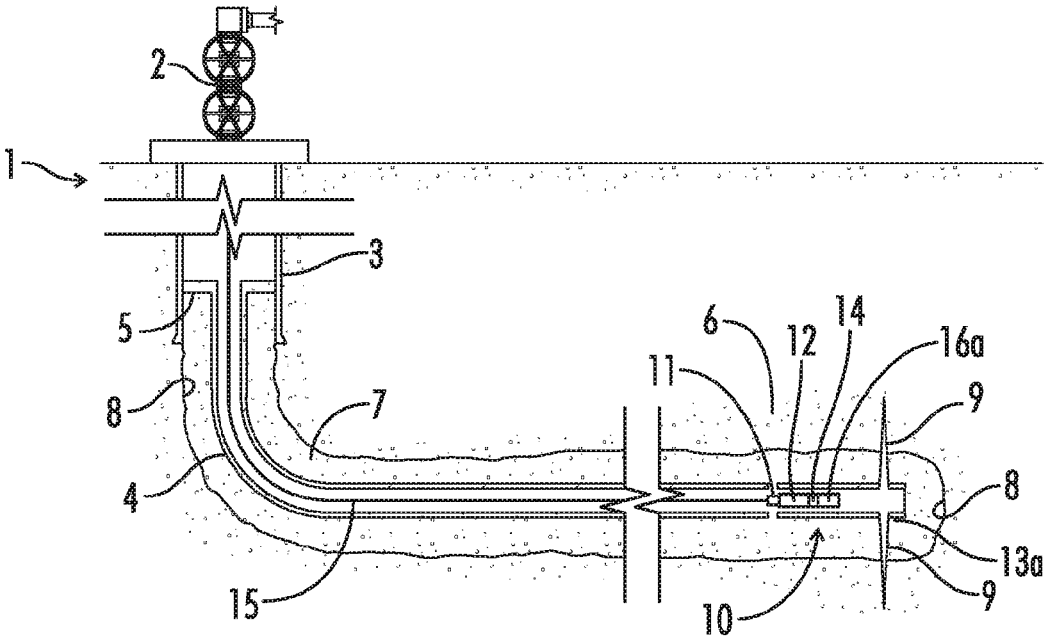
FIG. 1A is a schematic illustration of an early stage of a "plug and pert" fracturing operation showing a tool string 10 deployed into a liner assembly 4, where tool string 10 includes a perf gun 11, a setting tool 12, an adapter kit 14, and a first preferred embodiment 16 of the plug assemblies of the subject invention.

In the drawings and description that follows, like parts are identified by the same reference numerals. The drawing figures are not necessarily to scale. Certain features of the embodiments may be shown exaggerated in scale or in somewhat schematic form and some details of conventional design and construction may not be shown in the interest of clarity and conciseness.

DESCRIPTION OF ILLUSTRATIVE EMBODIMENTS

The present invention generally relates to plugs that may be used to isolate a portion of a well, and more particularly, to plugs that may be used in fracturing or other processes which require isolation of selected portions of a liner. Some broader embodiments of the novel plugs comprise an annular wedge having an inner ball seat, a sealing ring, and an annular slip. Other broad embodiments comprise an annular wedge, a plastic sealing ring which can expand radially without breaking, and an annular slip.

Overview of Plug and Perf Fracturing Operations

A first preferred frac plug 16, for example, will be described by reference to FIGS. 1-18. As may be seen in the schematic representations of FIG. 1, plugs 16 may be used to perform a "plug and perf" fracturing operation in an oil and gas well 1. Well 1 is serviced by a well head 2 and various other surface equipment (not shown). Well head 2 and the other surface equipment will allow frac fluids to be introduced into the well at high pressures and flow rates. The upper portion of well 1 is provided with a casing 3 which extends to the surface. A production liner 4 has been installed in the lower portion of casing 3 via a liner hanger 5. It will be noted that the lower part of well 1 extends generally horizontally through a hydrocarbon bearing formation 6 and that liner 2, as installed in well 1, is not provided with valves or any openings in the walls thereof. Liner 2 also has been cemented in place. That is, cement 7 has been introduced into the annular space between liner 2 and the well bore 8.

Figure 1B:
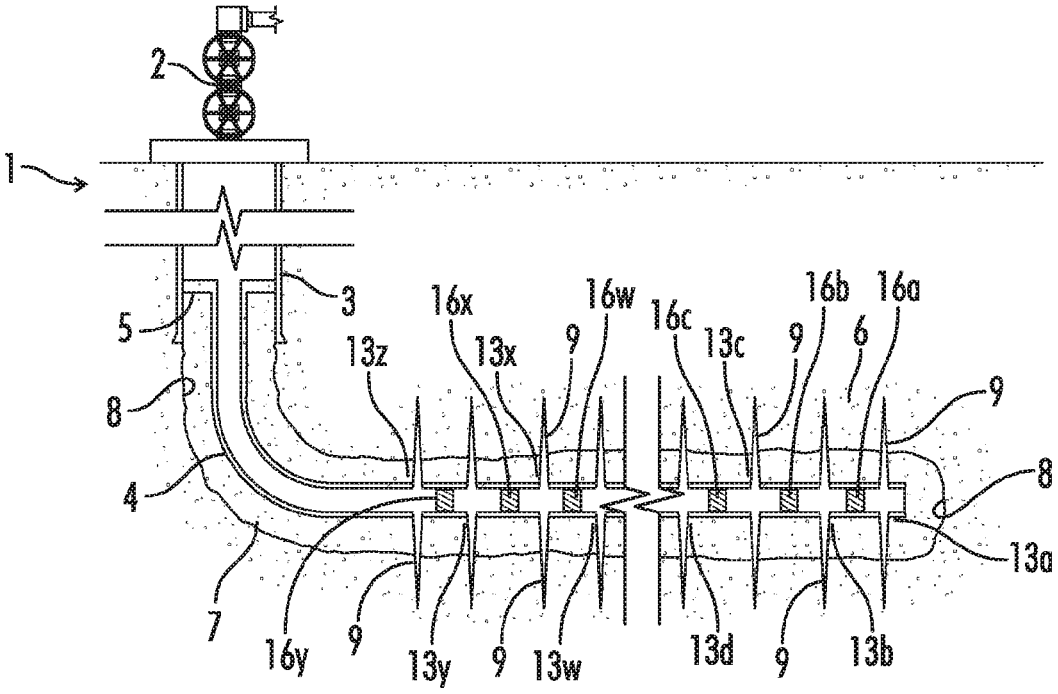
FIG. 1B is a schematic illustration of liner assembly 4 after completion of the plug and perf fracturing operation, but before removal of plugs 16 from liner 4.

FIG. 1A shows well 1 after the initial stage of a frac job has been completed. As discussed in greater detail below, a typical frac job will proceed from the lowermost zone in a well to the uppermost zone. FIG. 1A, therefore, shows that the bottom portion of liner 4 has been perforated and that fractures 9 extending from perforations 13*a* have been created in a first zone near the bottom of well 1. Tool string 10 has been run into liner 4 on a wireline 15.

Tool string 10 comprises a perf gun 11, setting tool 12, adapter kit 14, and frac plug 16*a*. Tool string 10 is positioned in liner 4 such that frac plug 16*a* is uphole from perforations 13*a*. Frac plug 16*a* is coupled to setting tool 12 by adapter kit 14 and, as discussed in greater detail below, will be installed in liner 4 by actuating setting tool 12.

Once plug 16*a* has been installed, setting tool 12 and adapter kit 14 will be released from plug 16*a*. Perf gun 11 then will be fired to create perforations 13*b* in liner 4 uphole from plug 16*a*. Perf gun 11, setting tool 12, and adapter kit 14 then will be pulled out of well 1 by wireline 15.

A frac ball (not shown) then will be deployed onto plug 16*a* to restrict the downward flow of fluids through plug 16*a*. Plug 16*a*, therefore, will substantially isolate the lower portion of well 1 and the first fractures 9 extending from perforations 13*a*. Fluid then can be pumped into liner 4 and forced out through perforations 13*b* to create fractures 9 in a second zone.

Additional plugs 16*b* to 16*y* then will be run into well 1 and set, liner 4 will be perforated at perforations 13*c* to 13*z*, and well 1 will be fractured in succession as described above until, as shown in FIG. 1B, all stages of the frac job have been completed and fractures 9 have been established in all zones.

Some operators may prefer to produce hydrocarbons from well 1 without removing plugs 16 from liner 4. In such instances, dissolvable frac balls will be used in the fracturing operation. Dissolvable balls, as their name implies, are fabricated from a material that dissolves, softens, or disintegrates in the presence of well fluids after a period of time (typically 1 to 30 days) such that the balls do not thereafter interfere with the upward flow of fluids through plugs 16.

More commonly, however, operators will prefer to remove plugs 16 from liner 4, even if dissolvable frac balls are employed. Frac plugs 16 may interfere with the installation of production equipment in liner 4 and, depending on production rates, may restrict the upward flow of production fluids through liner 4. Thus, for example, a motor with a drill bit may be deployed into liner 4 on coiled tubing. Mill bits also may be used but generally are less preferable. In either event, plugs 16 will be drilled out in succession from top to bottom. The drilling process, of course, creates debris which, if left in liner 4, may interfere with production equipment or otherwise may hinder production from well 1. Debris from plugs 16, therefore, preferably is circulated out of liner 4 during the drilling process.

It will be noted that FIG. 1 are greatly simplified schematic representations of a plug and perf fracturing operation. Production liner 4 is shown only in part as such liners may extend for a substantial distance. The portion of liner 4 not shown also will be provided with perforations 13 and plugs 16, and fractures 9 will be established therein. In addition, FIG. 1 depict only a few perforations 13 in each zone, whereas typically a zone will be provided with many perforations. Likewise, a well may be fractured in any number of zones, thus liner 4 may be provided with more or fewer plugs 16 than depicted.

The terms "upper" and "lower" as used herein to describe location or orientation are relative to the well and to the tool as run into and installed in the well. Thus, "upper" refers to a location or orientation toward the upper or surface end of the well. "Lower" is relative to the lower end or bottom of the well. It also will be appreciated that the course of the well bore may not necessarily be as depicted schematically in FIG. 1. Depending on the location and orientation of the hydrocarbon bearing formation to be accessed, the course of the well bore may be more or less deviated in any number of ways. "Axial," "radial," and forms thereof reference the central axis of the tool. For example, axial movement or position refers to movement or position generally along or parallel to the central axis. "Lateral" movement and the like generally refers to up and down movement or position up and down the tool.

Overview of First Preferred Frac Plug

The novel plugs incorporate a wedge, a sealing ring, and a slip, all of which have truncated inverted conical or other tapered surfaces. The tapered surfaces complement each other and allow the wedge to be driven into and radially expand the sealing ring and slip to seal and anchor the plug in a liner. For example, consider preferred novel frac plug 16 which is shown in isolation and in greater detail in FIGS. 2-4. As shown therein, plug 16 generally comprises an annular wedge 62, a sealing ring 64, and an annular slip 66. The construction of those plug components perhaps can be best appreciated from FIGS. 5-8. Annular wedge 62 is shown in isolation in FIG. 5, sealing ring 64 is shown in isolation in FIG. 6, and annular slip 66 is shown in isolation in FIGS. 7 and 8. All of those figures show plug 16 and its components in their as-fabricated, run-in state.

Figure 5:
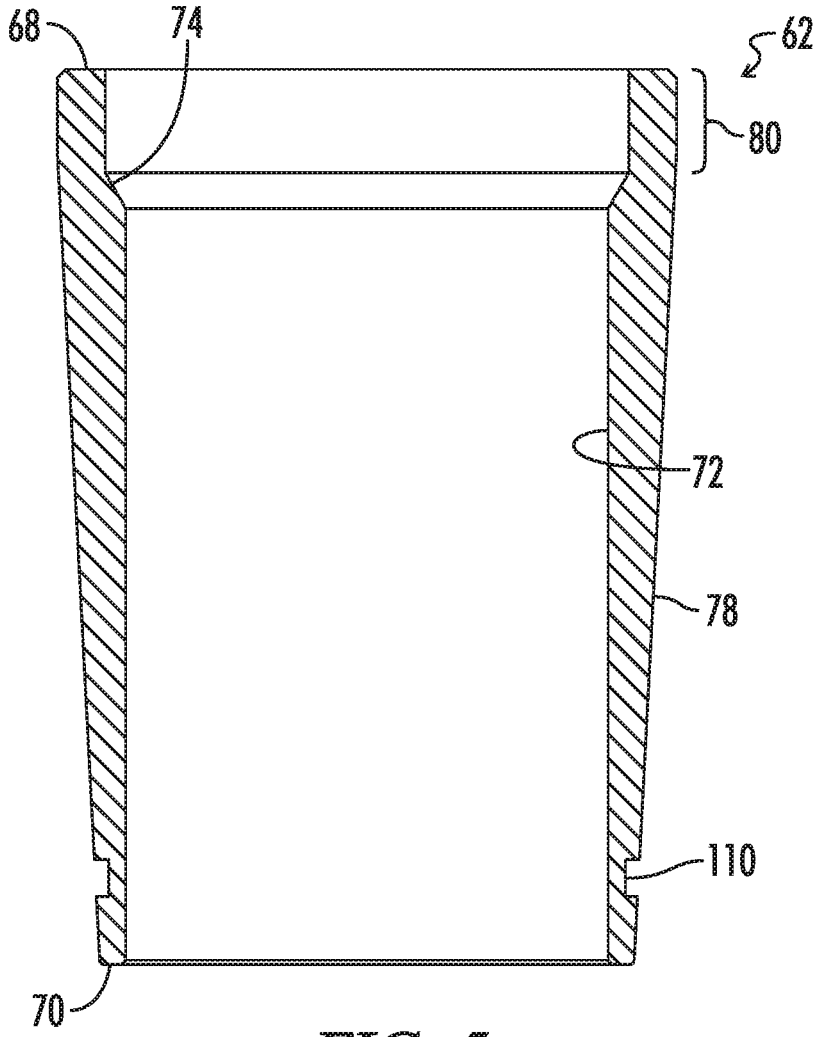
FIG. 5 is an enlarged axial cross-sectional view of an annular wedge 62 of plug 16.

As best seen in FIG. 5, wedge 62 may be described in general terms as having a generally tapered annular or open cylindrical shape. More particularly, wedge 62 has an axial passage or bore 72 extending from the upper end 68 of wedge 62 to the lower end 70 of wedge 68. An inner ball seat 74 is defined in wedge bore 72, bore 72 otherwise having a substantially uniform diameter. Ball seat 74 is provided by a shallow angle, upward facing tapered reduction in the diameter of wedge bore 72 situated axially below the upper end 68 of wedge 62.

The outer surface of wedge 62 in large part tapers radially outward from bottom to top. More specifically, the outer diameter of wedge 62 increases from the wedge lower end 70 toward the wedge upper end 68, thus providing wedge 62 with an inverted truncated conical outer surface 78 adjacent to the wedge lower end 70. Tapered outer surface 78 extends along the majority of the length of wedge 62 and terminates near its upper end 68. Though perhaps not readily apparent in FIG. 5, a relatively short upper portion 80 of wedge 62 has a substantially uniform, non-tapered outer diameter.

Figure 6:
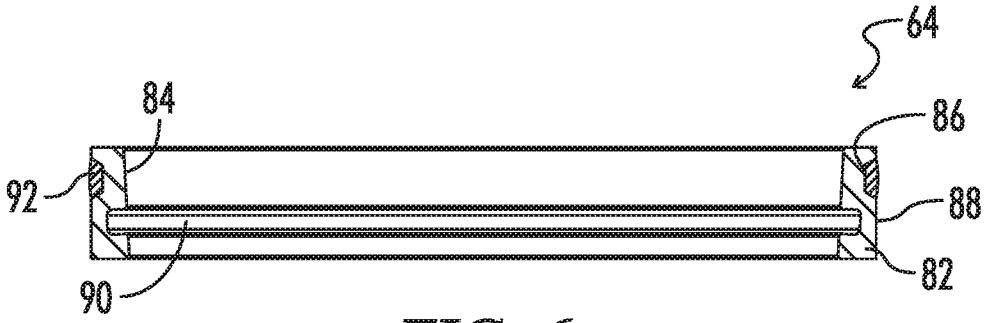
FIG. 6 is an enlarged axial cross-sectional view of a sealing ring 64 of plug 16.

As seen best in FIG. 6, sealing ring 64 has a relatively short, annular body 82 defining an axial passage or bore 84. Ring bore 84 has a generally inverted truncated conical shape, that is, it tapers radially outward from its lower end to its upper end. The taper of ring bore 84 is complementary to the tapered outer surface 78 of wedge 62. Sealing ring 64 preferably is provided with elastomeric seals which ultimately will enhance the seal between plug 16 and liner 4 when, as described in detail below, plug 16 is set. Thus, as appreciated best from FIG. 6, ring body 82 has an annular groove 86 in its outer surface 88 and an annular groove 90 in its ring bore 84. Outer groove 86 and inner groove 90 are filled, respectively, with elastomeric seal material 92 and 94. Elastomeric seal material 92 and 94 may be molded in grooves 86 and 90 or they may be molded and then inserted therein.

Figure 7:
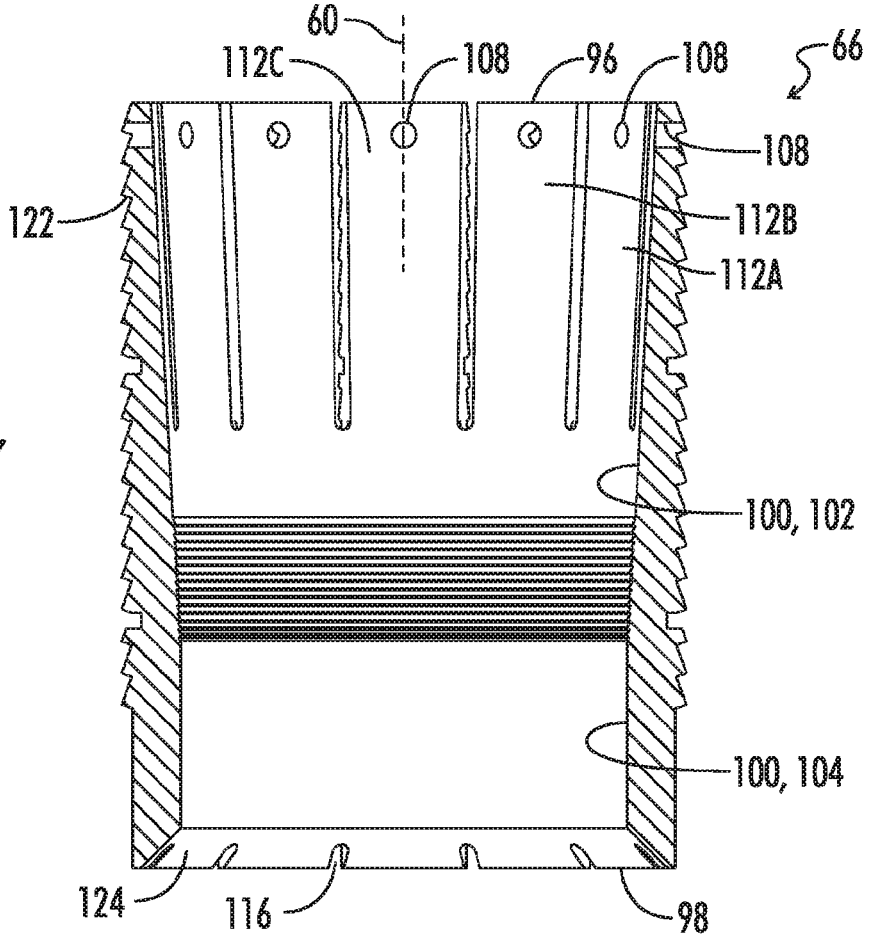
FIG. 7 is an enlarged axial cross-sectional view of an annular slip 66 of plug 16.
Figure 8:
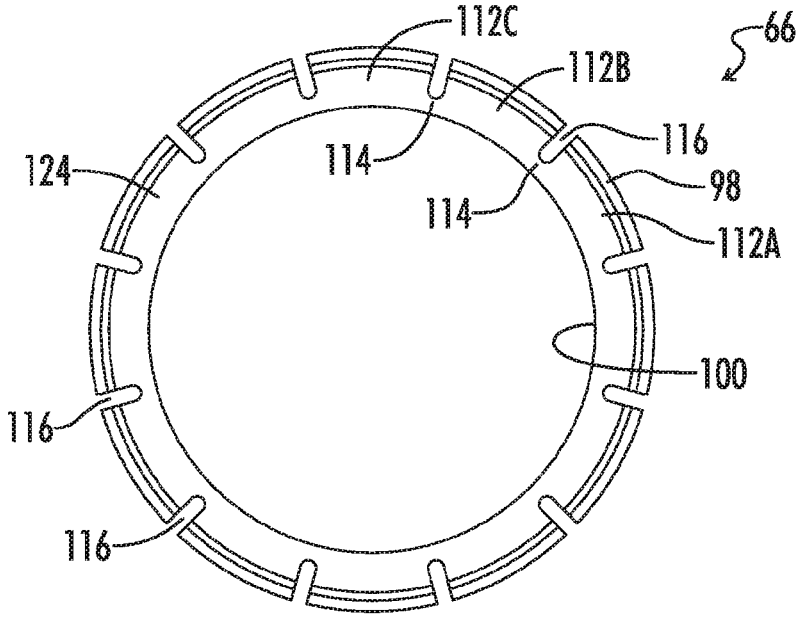
FIG. 8 is bottom elevational view of slip 66 of plug 16.
Figure 9A:
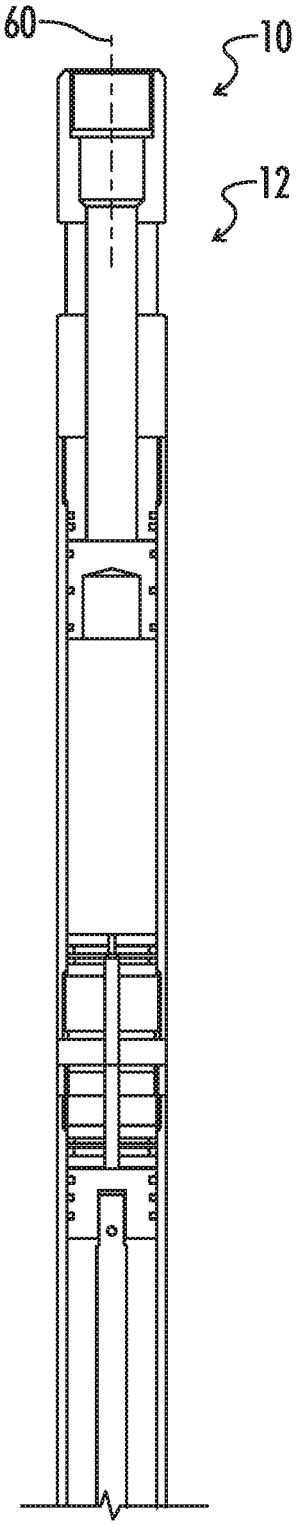
FIGS. 9A and 9B are axial cross-sectional views of a portion of a tool string 10 which includes setting tool 12, adapter kit 14 and plug 16. Setting tool 12, adapter kit 14, and plug 16 are shown as they are run into a well.
Figure 9B:
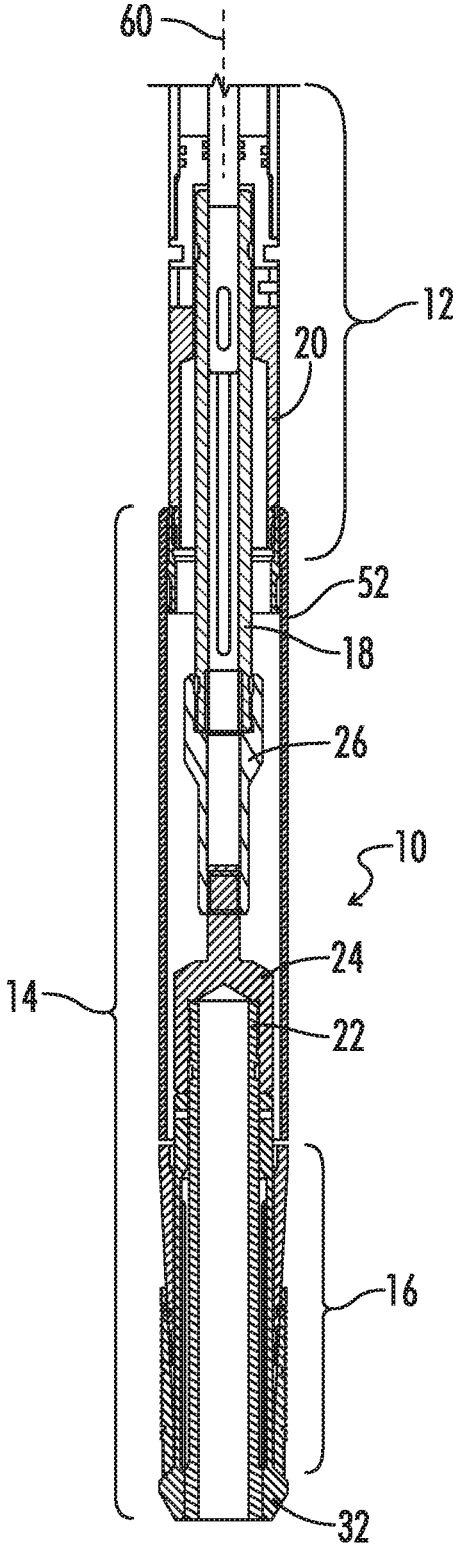
Figure 10:
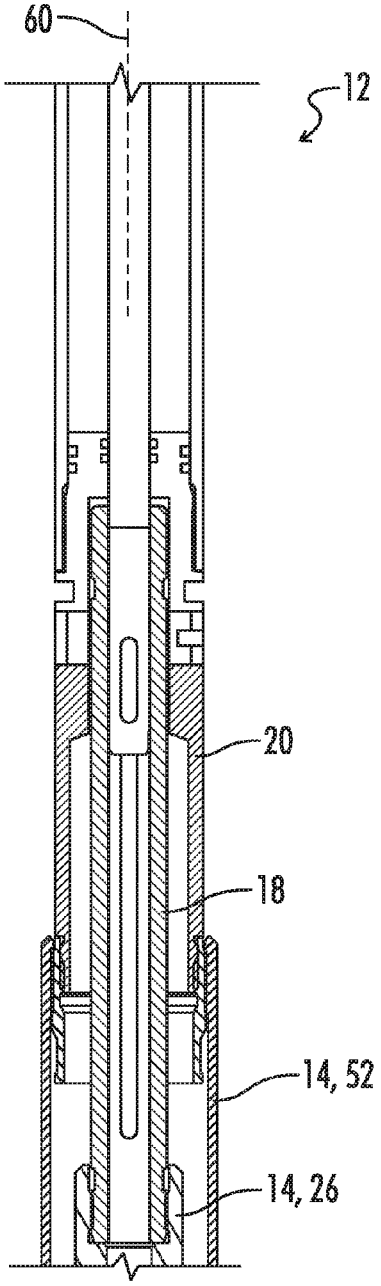
FIG. 10 is an enlarged cross-sectional view of a lower portion of setting tool 12, adapter kit 14, and plug 16 shown in FIGS. 9A-9B.

As best seen in FIGS. 7-8, slip 66 also may be described in general terms as having a generally tapered annular or open cylindrical shape. More particularly, slip 66 has an axial passage or bore 100 extending from the upper end 96 of slip 66 to the lower end 98 of slip 66. Slip bore 100 in large part has a generally inverted truncated conical shape, that is, it in large part tapers radially inward from top to bottom. More specifically, the inner diameter of slip bore 100 decreases from the slip upper end 96 toward the slip lower end 98, thus providing slip 66 with a tapered inner surface 102 adjacent the slip upper end 96. Tapered inner surface 102 extends along most of slip bore 100 and terminates near the lower end 98 of slip 66. The taper of inner surface 102 of slip 66 is complementary to the taper of outer surface 78 of wedge 62. Though perhaps not readily apparent in FIG. 7, a relatively short lower portion 104 of slip bore 100 has a substantially uniform, non-tapered inner diameter.

Slip 66 is a breakaway type slip which is designed to break apart into a number of segments. More particularly, slip 66 has a plurality of slip segments 112, such as slip segments 112A, 112B, and 112C. Slip segments 112 are joined initially by frangible portions 114. Slip segments 112 are arranged around the circumference of slip 66 and extend laterally (or lengthwise) from the slip upper end 96 to the slip lower end 98. Longitudinal cuts separate the upper portion of adjacent slip segments 112 and align with grooves 116 in the outer surface of slip 66. When plug 16 is set, as described in detail below, the longitudinal cuts and grooves 116 encourage slip segments 112 to break apart at frangible portions 114. Alternately, however, slip 66 may be assembled from discrete slip segments. In any event, the substantial length of the outer surface of slip segments 112 is covered with downward facing serrations or teeth which will allow slip segments 112 to engage and grip liner 4.

As described in greater detail below, wedge 62 will be driven downward into sealing ring 64 and annular slip 66. As wedge 62 is driven downward, it will force sealing ring 64 and slip 66 to expand and thereby set and seal plug 16 in liner 4. The operation of plug 16 perhaps can be best appreciated from FIGS. 2-4 which show plug 16, respectively, as it is run into well 1 and positioned in liner 4, after it has been set in liner 4, and with a frac ball 76 seated in plug 16 to isolate lower portions of liner 4.

Figure 2:
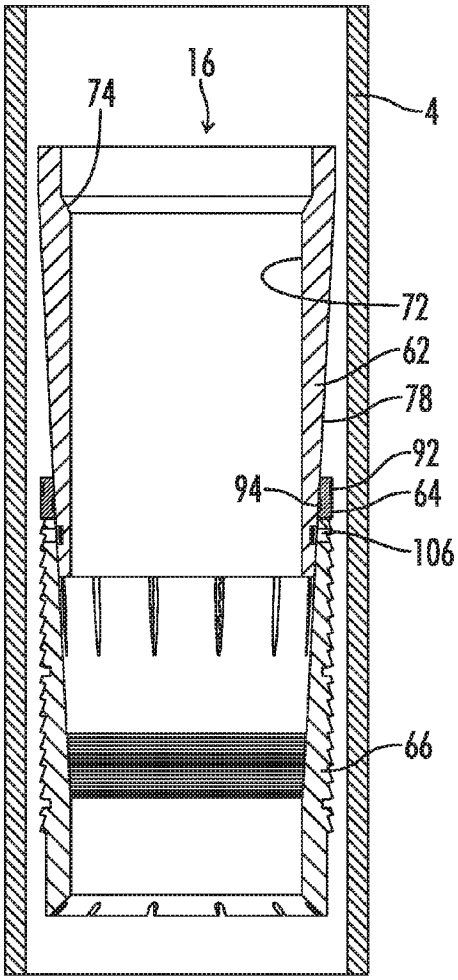

As shown in FIG. 2, when plug 16 is assembled for running into a well, wedge 62 is situated generally above slip 66. Preferably, to ensure reliable displacement of wedge 62 into slip 66 and to reduce the length of plug 16, lower end 70 of wedge 62 is received in upper end 96 of slip 66 as shown. Thus, the smaller outer diameter portion of tapered outer surface 78 of wedge 62 engages the upper, larger inner diameter portion of tapered inner surface 102 of slip 66. Sealing ring 64 is carried on tapered outer surface 78 of wedge 62 near its lower end 70 and above slips 66. Preferably, as shown, sealing ring 64 abuts the upper end 96 of slip 66.

Preferably the wedge and slip are releasably connected to each other to prevent unintended setting of the plug as it is run into a well. For example, as shown in FIG. 2, plug 16 is provided with a plurality of shear pins 106. Shear pins 16 extend through radial bores 108 near the upper end 96 of slip 66 and into an annular groove 110 in the tapered outer surface 78 of wedge 62 near its lower end 70. Preferably, as shown, there is one shear pin 106 provided for each slip segment 112. Shear pins 106 serve as a frangible retainer which prevents relative movement between wedge 62 and slip 66 as plug 16 is run into a well, but allows movement when a predetermined actuating force is applied across shear pins 66. Shear pins 66 made be made of relatively soft metals, such as brass or aluminum. It will be appreciated, however, that any number of frangible connectors are known in the art and may be used to releasably connect wedge 62 and slip 66.

Figure 3:
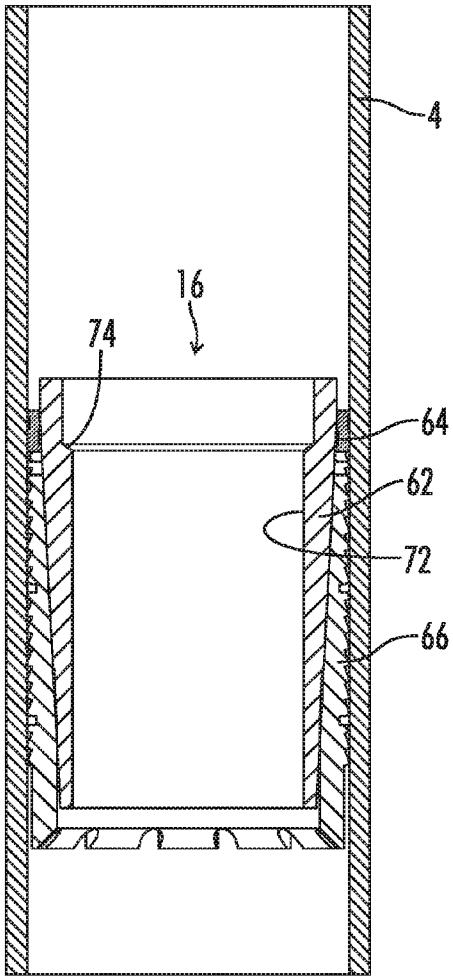

FIG. 3 shows plug 16 after it has been set in liner 4. As will be appreciated by comparing FIG. 3 to FIG. 2, shear pins 106 have been sheared and wedge 62 has been driven into sealing ring 64 and slip 66. Wedge 62 has traveled axially downward to a point where sealing ring 64 is now proximate to the upper end 68 of wedge 62. As wedge 62 travels axially downward, the complementary tapers on outer surface 78 of wedge 62 and on ring bore 84 and inner surface 102 of slip 66 allow wedge 62 to ride under sealing ring 64 and slip 66. As wedge 62 rides under sealing ring 64 and slip 66, it forces them to expand radially from their nominal run-in outer diameters.

In accordance with a preferred aspect of the subject invention, body 82 of sealing ring 64 is fabricated from a sufficiently ductile material to allow sealing ring 64 to expand radially into contact with liner 4 without breaking. As sealing ring 64 expands radially, outer elastomeric seal 92 seals against liner 4 and inner elastomeric seal 94 seals against outer surface 78 of wedge 62. Sealing ring 64 is thus able to provide a seal between plug 16 and liner 4.

As slip 66 is expanded radially by wedge 62 at least some of the frangible portions 114 between slip segments 112 break, allowing individual slip segments 112 to expand further into contact with liner 4. Slip segments 112, therefore, are able to anchor plug 16 within liner 4. Upper end 96 of slip 66 abuts the lower end of sealing ring 64, thus also providing hard backup for sealing ring 64 as it expands radially to seal against liner 4.

Figure 4:
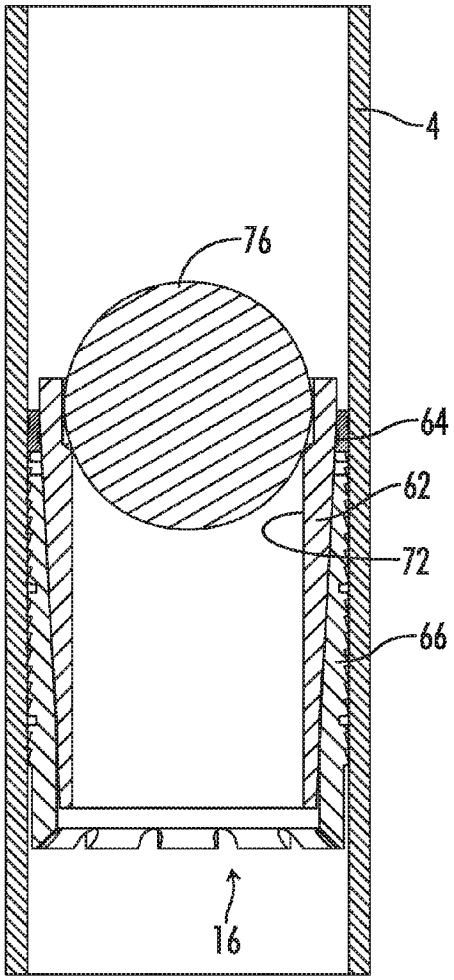
FIGS. 2-4 are sequential axial cross-sectional schematic views of plug 16 in a well liner 4 which omit, for the sake of clarity, various components of adapter kit 14.

Once plug 16 has been sealed and anchored in liner 4, a frac ball may be flowed into well 1 to restrict the flow of fluid through plug 16 and to substantially isolate portions of well 1 below plug 16. More specifically, as shown in FIG. 4, a frac ball 76 may be deployed onto seat 74. As best seen in FIGS. 3 and 5, ball seat 74 provides a beveled shoulder upon which ball 76 will rest. Moreover, as seen in FIGS. 3 and 4, when wedge 62 has been fully inserted into slip 66, ball seat 74 is situated axially between the upper end of sealing ring 64 and the lower end 98 of slip 66. More specifically, ball seat 74 is situated axially proximate to, and almost directly inward of sealing ring 64. Thus, when hydraulic pressure is applied to ball 76, a portion of the force transmitted from ball 76 to wedge 62 will be directed radially outward through sealing ring 64. Moreover, given the circular contact point between ball 76 and seat 74, that force will be directed uniformly outward through the circumference of seat 74. The force transmitted through ball 76 and seat 74 will help ensure that sealing ring 64 maintains an effective seal between plug 16 and liner 4.

Other closure devices and arrangements, however, may be used in the novel plugs. For example, a standing valve may be used to restrict passage through the wedge bore. Non-spherical closure devices may be used as well, along with non-circular seats and wedge bores. Moreover, as used herein, the term "bore" is only used to indicate that a passage exists and does not imply that the passage necessarily was formed by a boring process or that the passage is axially aligned with the well bore or tool.

Similarly, outer surface 78 of wedge 62, bore 84 of sealing ring 64, and bore 100 of slip 66 all have been described as having an inverted truncated conical shape. It will be appreciated, however, that the mating tapered surfaces of wedge 62, sealing ring 64, and slip 66 may have different geometries. Wedge 62, for example, may be provided with a number of discrete, flat ramped surfaces arrayed circumferentially about its outer surface 78. Such ramps may be visualized as bevels or as grooves on a conical surface or, as the sides of a tapered prism having a polygonal cross-section. Bore 84 of sealing ring 64 and bore 100 of slip 66 would be modified so that they mate with and accommodate wedge 62 as it is driven downward. For example, the novel plug may be provided with discrete slip segments which ride up flat grooves or tracks provided in the wedge.

In general, the novel plugs may be fabricated from materials typically used in plugs of this type. Such materials may be relatively hard metals, especially if removal of the plugs is not necessary, but typically the materials will be relatively soft, more easily drilled materials. For example, wedge 62 and slip 66 may be fabricated from non-metallic materials commonly used in plugs, such as fiberglass and carbon fiber resinous materials. The components may be molded, but more typically will be machined from wound fiber resin blanks, such as a wound fiberglass cylinder. Alternately, suitable wedges and slips may be fabricated from softer or more brittle metals that are easier to drill. For example, slip 66 may be fabricated from surface hardened cast iron, especially cast iron having a surface hardness in the range of 50-60 Rockwell C. Such materials and methods of fabricating wedge and slip components are well known in the art and may be obtained commercially from many sources.

As noted, the sealing ring in the novel plugs preferably are fabricated from a sufficiently ductile material so as to allow the ring to expand radially into contact with a liner without breaking. For example, ring body 82 may be fabricated from aluminum, bronze, brass, brass, copper, mild steel, or magnesium and magnesium alloys. Alternately, the ring body may be made of hard, elastomeric rubbers, such as butyl rubber.

Preferably, however, the sealing ring is fabricated from a plastic material. Plastic components are more easily drilled and the resulting debris more easily circulated out of a well. Engineering plastics, that is, plastics having better thermal and mechanical properties than more commonly used plastics, are preferred. Engineering plastics that may be suitable for use include polycarbonates and Nylon 6, Nylon 66, and other polyamides, including fiber reinforced polyamides such as Reny polyamide. "Super" engineering plastics, such as polyether ether ketone (PEEK) and polyetherimides such as Ultem®, are especially preferred. Mixtures and copolymers of such plastics also may be suitable. Preferred materials generally will have useful operating temperatures of at least 250° F., and preferably at least 350° F., and a tensile strength of a least 5,000 psi, preferably at least about 1,500 psi. Such preferred materials also generally will provide the ring body with an elongation factor of at least 10%, and preferably at least 30%.

As noted above, the sealing ring may be provided with elastomeric material around its outer or inner surface. Such elastomeric materials include those commonly employed in downhole tools, such as butyl rubbers, hydrogenated nitrile butadiene rubber (HNBR) and other nitrile rubbers, and fluoropolymer elastomers such as Viton.

Overview of Preferred Tool String

The novel plugs typically will be run into a well as part of a tool string 10 which includes a perf gun 11, setting tool 12, and adapter kit 14 as shown schematically in FIG. 1A. Perf gun 11, as noted above, is used to perforate liner 4. Adapter kit 14 releasably connects and transmits setting force from setting tool 12 to plug 16. Tool string 10 also may incorporate additional tools to facilitate the fracturing operation or to perform additional operations. For example, sinker bars, centralizers, rope sockets, pump down fins, and collar locators may be incorporated into tool string 10.

Tool string 10, as described above, may be run into well on wireline 15. Wirelines are heavy cables that include electrical wires through which a tool, such as perf gun 11 and setting tool 12, may be actuated or otherwise controlled. Fluid will be pumped into the well to carry the tools to the desired location in the liner. Other conventional equipment, however, such as coiled tubing or pipe, may be used to deploy the novel plugs and tool strings in a liner.

FIGS. 9-16 show setting tool 12, adapter kit 14, and plug 16 in greater detail during various stages of deploying and operating those tools, with FIGS. 9-12 showing the tools Dec. 14, 2016 as they are run into a well. As may be seen therein, plug 16 is coupled at its upper end to adapter kit 14 which is connected to setting tool 12.

A variety of setting tools and adapter kits may be used with the novel plugs. For example, setting tool 12 is a pyrotechnic "Baker Style" setting tool similar to the E-4 series pyrotechnic setting tools sold by Baker Hughes. It has combustible powder charges which are electrically ignited through a wireline. Ignition of the charges generates pressure that will actuate the tool. Other pyrotechnic setting tools, however, may be used, such as the Compact wireline setting tools sold by Owen Oil Tools, the GO-style setting tools available from The Wahl Company, and the Shorty series tools available from Halliburton. Likewise, other types of setting tools may be used. For example, electrohydraulic setting tools, such as Weatherford's DPST setting tool, may be used. Hydraulic setting tools, such as Schlumberger's Model E setting tool, or ball activated hydraulic setting tools, such as Weatherford's HST setting tool and American Completion Tools Fury 20 setting tools, also may be used. If hydraulic setting tools are used, the tools will be run in a coiled tubing or a pipe string.

Details of the construction and operation of such setting tools are well known in the art and will not be expounded upon. Suffice it to say, however, that setting tool 12 includes an inner part 18 and an outer part 20, as may be seen in FIGS. 9-10. When setting tool 12 is actuated, outer part 20 moves downward relative to inner part 18 transmitting actuating force through adapter kit 14 to plug 16.

Likewise, various adaptor kits may be used with the novel plugs, the specific design of which will be tailored to a particular setting tool. Adapter kit 14, for example, generally includes a setting tool adapter 26, a top cap 24, an inner mandrel 22, a collet or release sleeve 32, an adjusting sleeve 54, and an outer setting sleeve 52. Adapter 26, top cap 24, inner mandrel 22, and release sleeve 32 in general serve to releasably connect plug 16 to inner part 18 of setting tool 12. Adjusting sleeve 54 and outer setting sleeve 52 serve generally to transmit downward movement of setting tool outer part 20 to plug 16.

Figure 11:
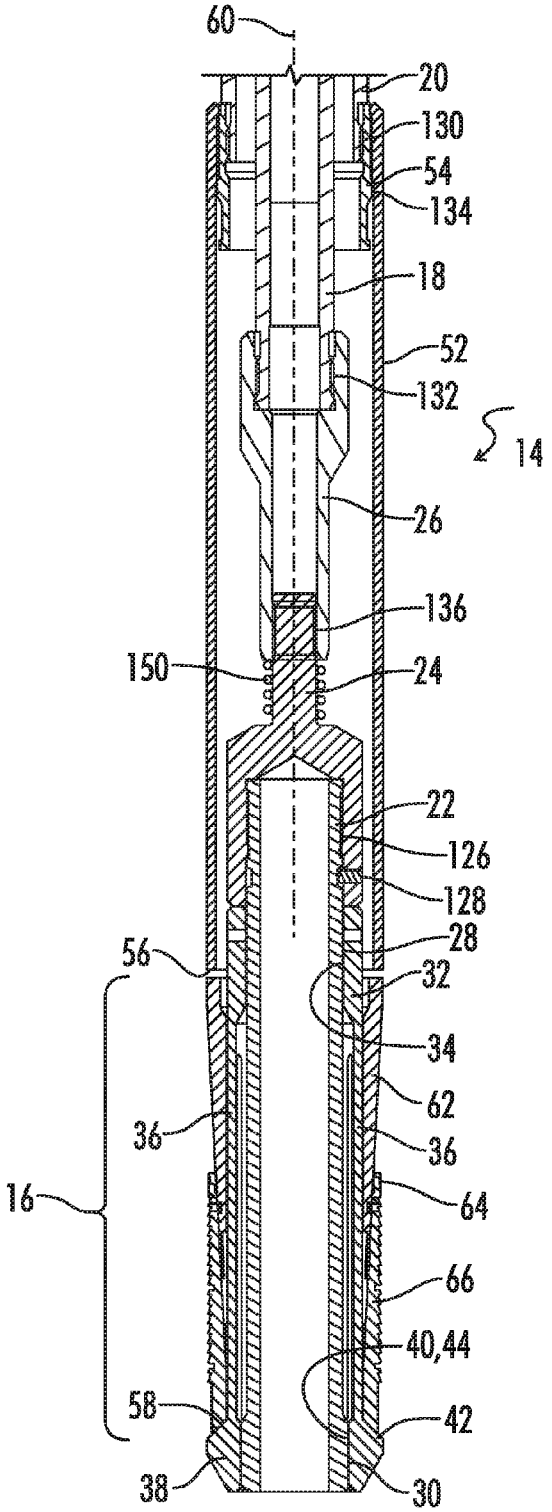
FIG. 11 is an enlarged axial cross-sectional view of adapter kit 14 and plug 16 shown in FIGS. 9B and 10. Adapter kit 14 and plug 16 are in their unactuated, run-in state.

As seen best in FIG. 11, inner mandrel 22 of adapter kit 14 has a generally open cylindrical shape. It is connected to the lower end of inner part 18 of setting tool 12 by setting tool adapter 26 and top cap 24. Release sleeve 32 is carried on mandrel 22 and in turn carries plug 16.

More particularly, mandrel 22 includes an upper cylindrical outer surface 28 and a lower, enlarged diameter cylindrical outer surface 30. Release sleeve 32 has an upper generally cylindrical portion defining an inner bore 34. Mandrel 22 extends through bore 34 of release sleeve 32, with release sleeve 32 being carried about the upper portion of outer surface 28 of mandrel 22. A plurality of collet arms 36 extend downward from the upper portion of release sleeve 32. Each collet arm 36 includes a collet head 38. Collet heads 38 have a radially inward extending protrusion 40 and a radially outward extending protrusion 42. Radially inward surface 44 on inward extending protrusions 40 of collet heads 38 slidably engage the lower, enlarged diameter outer surface 30 of mandrel 22. It will be appreciated, therefore, that except at their heads 38, collet arms 36 are concentrically spaced radially outward of mandrel 22.

During operation of setting tool 12, mandrel 22 can slide freely within bore 34 of release sleeve 32. Initially, however, mandrel 22 and release sleeve 32 are releasably restricted from relative movement as they are run into well 1. As described further below, the releasable connection between mandrel 22 and release sleeve 34 prevents plug 16 from being set prematurely as it is run into a well. It can be broken after plug 16 is deployed, however, to allow plug 16 to be installed and ultimately to allow setting tool 12 and adapter kit 14 to be released and withdrawn from plug 16.

Figure 12:
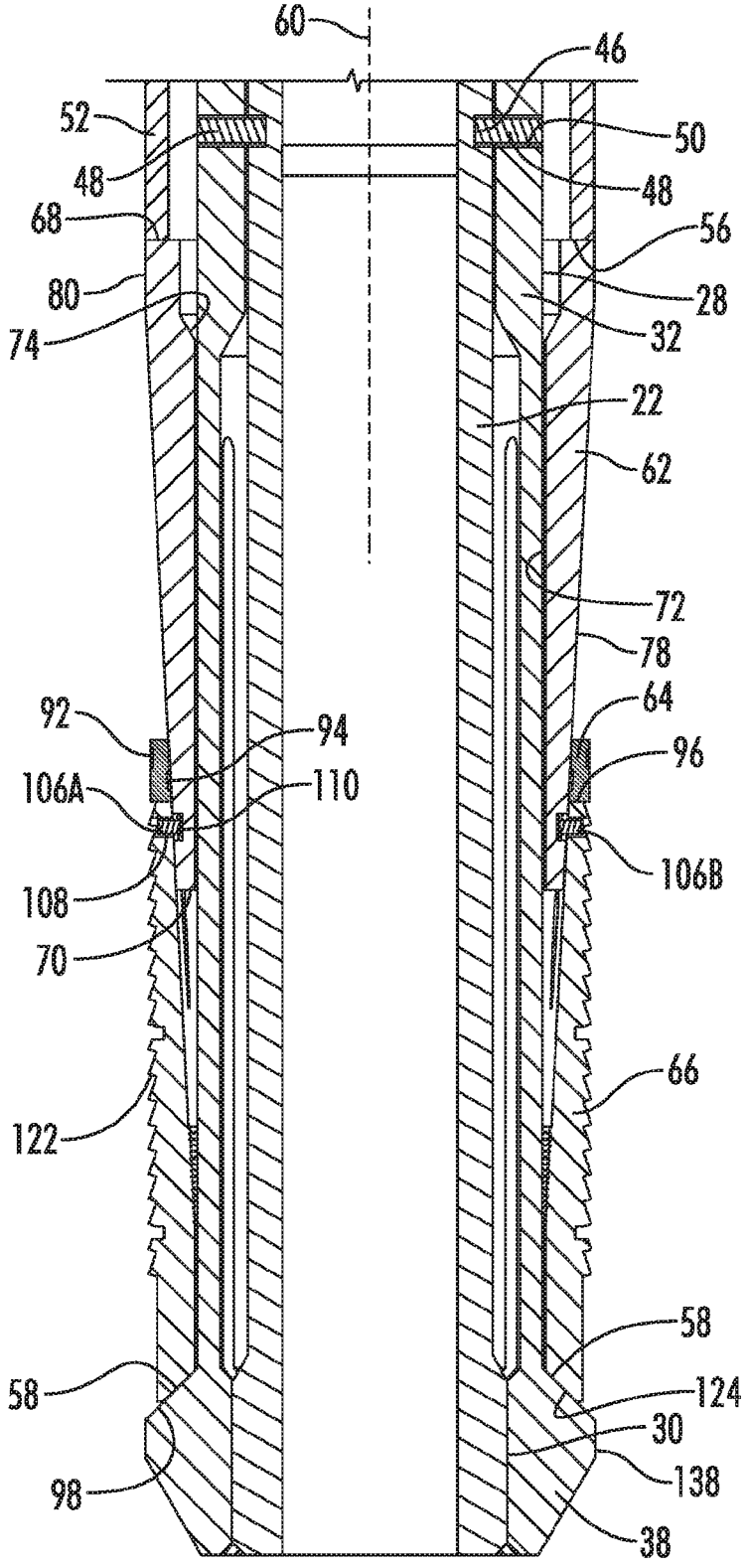
FIG. 12 is a still further enlarged axial cross-sectional view of plug 16 and various components of adapter kit 14.

Thus, as shown in FIG. 12, upper outer surface 28 of mandrel 22 has an annular groove 46, and the upper portion of release sleeve 32 has a plurality of radial bores 50. Shear pins 48 extend through radial bores 50 and into groove 46, thus collectively providing what may be referred to as connector 48 and a frangible connection between mandrel 22 and release sleeve 32. Other frangible connections, however, may be used with other interfering geometries. For example, instead of groove 46 a series of detents, spotfaces, or threaded, flat-bottomed, or through holes may be machined into mandrel 22.

Outer setting sleeve 52 of adapter kit 14 is a generally cylindrical sleeve which is disposed about and radially spaced outward from mandrel 22. As seen in FIG. 11, outer setting sleeve 52 is connected to the lower end of outer part 20 of setting tool 12 via an adjusting sleeve 54. It will be appreciated that in their run-in, unset state, plug 16 is carried on release sleeve 32 between collet heads 38 and outer setting sleeve 52.

More particularly, as seen best in FIG. 12, outer setting sleeve 52 includes a downward facing lower end or setting surface 56. Setting surface 56 is substantially normal or perpendicular to the longitudinal axis 60 of the tools such that it can abut and bear on the upper end 68 of plug wedge 62. Outward protrusion 42 of collet heads 38 have an upwardly facing setting surface 58. Setting surfaces 58 are tapered downwardly and outwardly, thus mating with the upwardly and inwardly taper surface 124 at the lower end 98 of plug slip 66.

It will be appreciated that the liner into which frac plugs are deployed may not have a uniform diameter. There may be protrusions in the liner resulting from accumulation of debris, scale, and rust. The liner also may have manufacturing defects or dents and other damage caused by well operations. Moreover, well fluids can contain solids and debris. Tolerances between the frac plug and the nominal inner diameter of the liner can be relatively small, leaving only a small gap allowing for the downward travel of the plug and for the flow of fluid between the plug and liner. Thus, frac plugs can be susceptible to getting stuck, damaged, or prematurely set as they are deployed into a liner.

Accordingly, the novel plugs and tool strings preferably are provided with gauge points or surfaces to facilitate deployment and to protect the tool as it is deployed. Thus, as may be seen in FIG. 12, which shows plug 16 in its unset, run-in position, the outside diameter of wedge 62 at its upper cylindrical outer surface portion 80 is substantially equal to an outer diameter defined by outer surfaces 138 of collet heads 38. The outside diameters of sealing ring 64 and slip 66 are less than the outside diameters of wedge outer surface portion 80 and collet head outer surface portions 138. Surfaces 80 and 138, therefore, serve as gauge points supporting plug 16 against liner 4 and minimizing contact between sealing ring 64 and slip 66 and liner 4 as plug 16 is deployed through liner 4. Preferably, the tolerances are such that it provides sufficient clearance for plug 16 to be lowered past more typically encountered obstructions, protrusions, and bends in liner 4 without catching or damage. Such protection is particularly important when plug 16 is deployed into horizontally oriented portions of liner 4.

The outer surfaces of setting sleeve 52 of adapter kit 14 and outer part 20 of setting tool 12 also preferably are treated with a friction reducing material such as Teflon®, Xylan®, and other fluoropolymers or other similar materials. Such materials can reduce resistance to deployment of the tool string through a liner. Reducing resistance is particularly helpful when the tool string is being pumped into or through a horizontal portion of a liner on a wireline.

Figure 17:
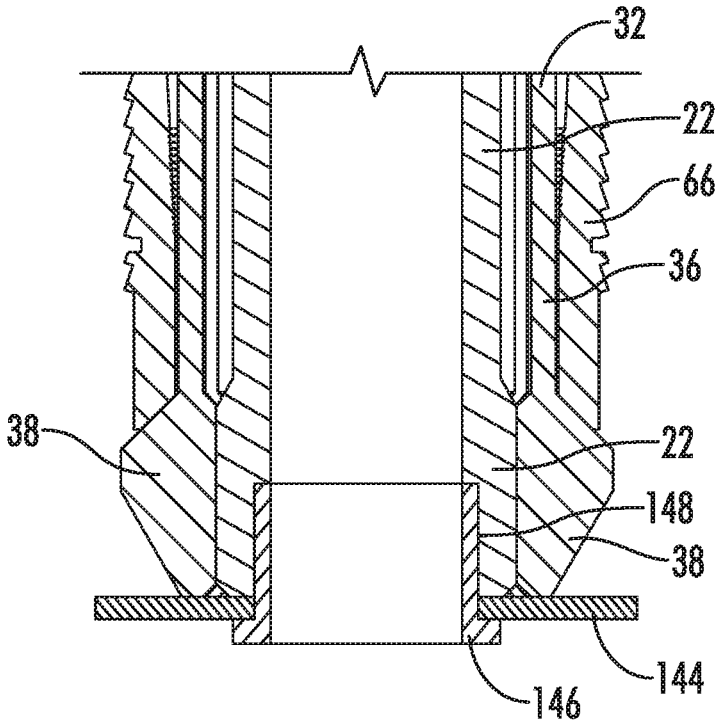
FIG. 17 is an axial cross-sectional view of the lower end of adapter kit 14 and plug 16 shown in FIG. 12 with an optional pump down fin 144 connected to adapter kit 14.

Moreover, if tool string 10 will be pumped down liner 4 on wireline 15, and especially if it will be pumped into a horizontal extension of liner 4, plug 16 preferably is provided with a pump down fin 144. As shown in FIG. 17, pump down fin 144 is attached to the lower end of mandrel 22 by an annular nut 146 threaded into threads 148 provided inside mandrel 22. It will be appreciated that pump down fin is sized such that it can slidingly engage liner 4 and thus assist in pumping tool string 10 into liner 4. Pump down fin 144 also preferably is composed of a rubber or elastomeric material and is somewhat flexible so that, as described in detail below, it does not impede release or withdrawal of adapter kit 14 from plug 16.

Figure 13:
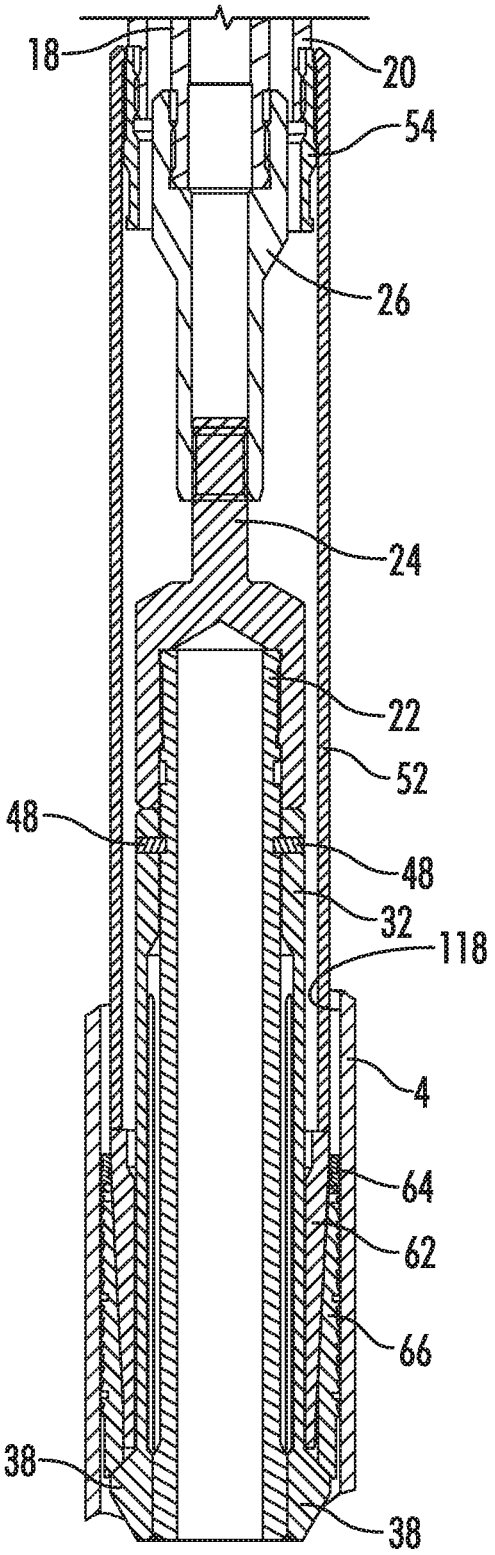
FIGS. 13-16 are sequential axial cross-sectional views of adapter kit 14 and plug 16 which, together with FIGS. 11-12, illustrate the operation of setting tool 12 and adapter kit 14 as they are deployed into a well with plug 16, are actuated to install plug 16 in liner 4, and then are released from plug 16.

FIG. 13 shows adapter kit 14 and plug 16 after setting tool 12 has been actuated to set plug 16 in liner 4. Specifically, it will be noted that outer part 20 of setting tool 12 and setting sleeve 52 of adapter kit 14 have moved axially downward. Downwardly facing setting surface 56 of setting sleeve 52 and upwardly facing setting surface 58 on collet heads 38 are aligned, thus allowing plug 16 to be compressed longitudinally therebetween. More particularly, as described in detail above, wedge 62 has been driven into sealing ring 62 and slip 66 to seal and anchor plug 16 in liner 4.

It will be appreciated that wedge 62 is described as being displaced downward into sealing ring 62 and slip 66 as plug 16 is set. During normal operation of setting tool 12 wedge 62 will be driven downward in an absolute sense, that is, it will move further down liner 4 while sealing ring 62 and slip 66 remain in place relative to liner 4. In other words, wedge 62 will be driven into sealing ring 62 and slip 66, instead of sealing ring 62 and slip 66 being pushed up and over wedge 62. If any of the tools hang up in liner 4, however, that may not be strictly the case. Thus, "downward" movement of wedge 62 will be understood as relative to sealing ring 62 and slip 66.

Figure 14:
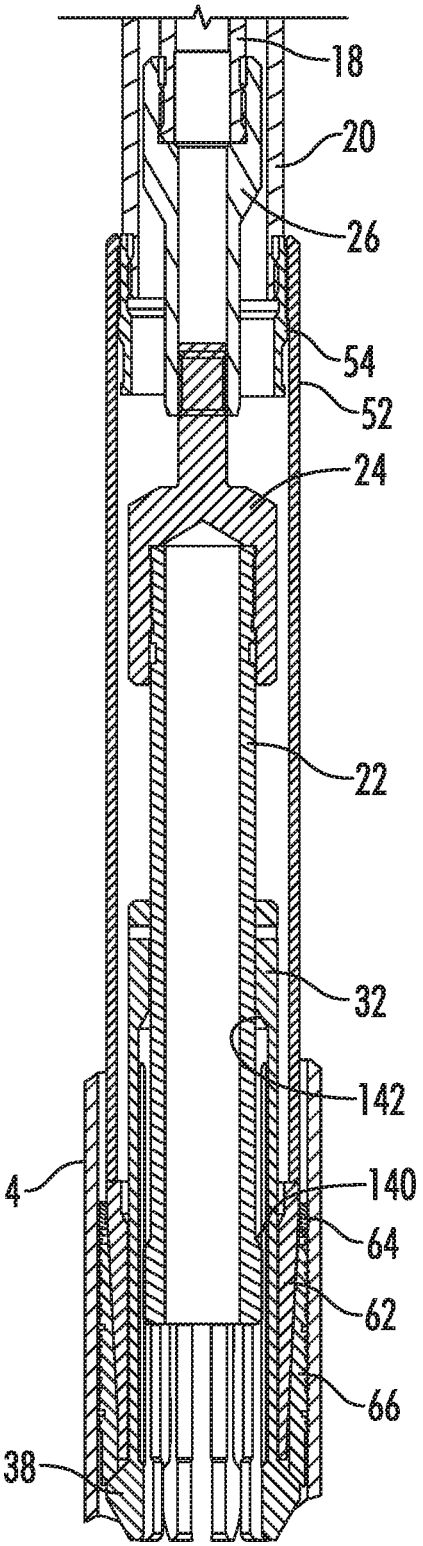

FIG. 14 shows an initial stage of releasing and withdrawing adapter kit 14 from set plug 16. As noted above, mandrel 22 and release sleeve 32 of adapter kit 14 initially are restricted from moving relative to each other by frangible connector 48. Frangible connector 48, however, is subjected to shear forces as plug 16 is set. Specifically, a downward force is applied by setting tool outer part 20 to release sleeve 32 (through adapter kit setting sleeve 52, plug 16, and collet heads 38) and an upward force is applied by setting tool inner part 18 to mandrel 22. After plug 16 is fully set, those shear forces will increase rapidly until they exceed a predetermined setting force. It will be appreciated, of course, that the number, size, and composition of shear pins 50 or other frangible connectors may be varied to provide the desired upper limit of setting force which can be applied to plug 16.

At that point, frangible connector 48 will shear, eliminating any further compressive force on plug 16. As will be appreciated by comparing FIG. 14 to FIG. 13, shearing of frangible connection 48 also allows mandrel 22 (and setting tool inner part 18) to begin moving upward relative to release sleeve 32 (and setting tool outer part 20). Release sleeve 32 at this point is still held in position by plug 16 by the engagement of collet heads 38 with the lower end 98 of slip 66. It also will be noted that pump down fin 144, if provided, will be deformed and will not impede travel of mandrel 22 upward through release sleeve 32.

Figure 15:
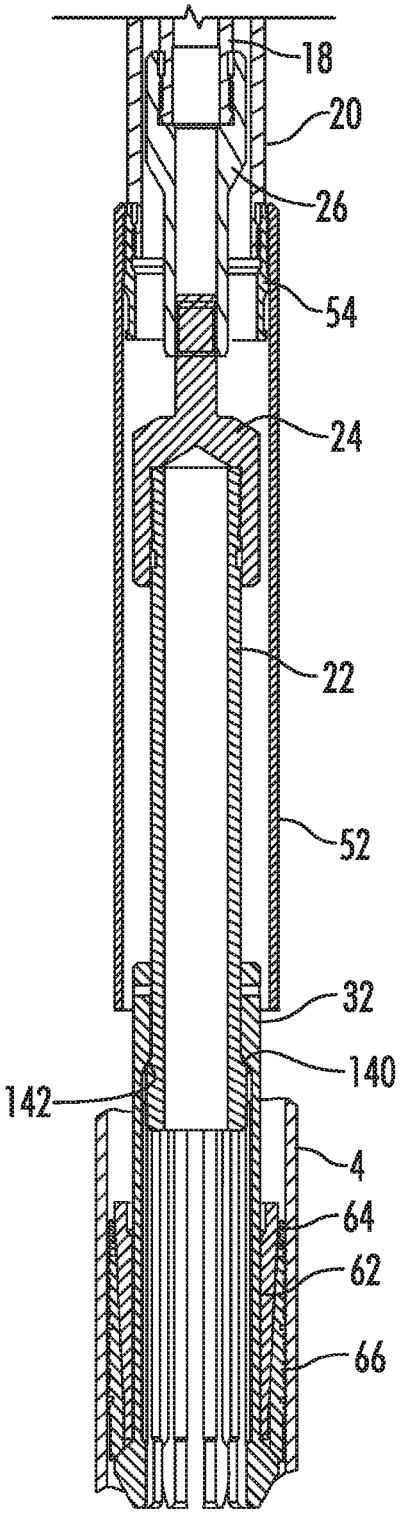

FIG. 15 shows an intermediate stage of releasing and withdrawing adapter kit 14 from set plug 16. As seen therein, mandrel 22 has continued traveling upward to a point where it engages collet sleeve 32. In particular, the outer, upward facing shoulder 140 on the lower end of mandrel 22 now is bearing on an inner, downward facing shoulder 142 on the upper end of release sleeve 32.

Figure 16:
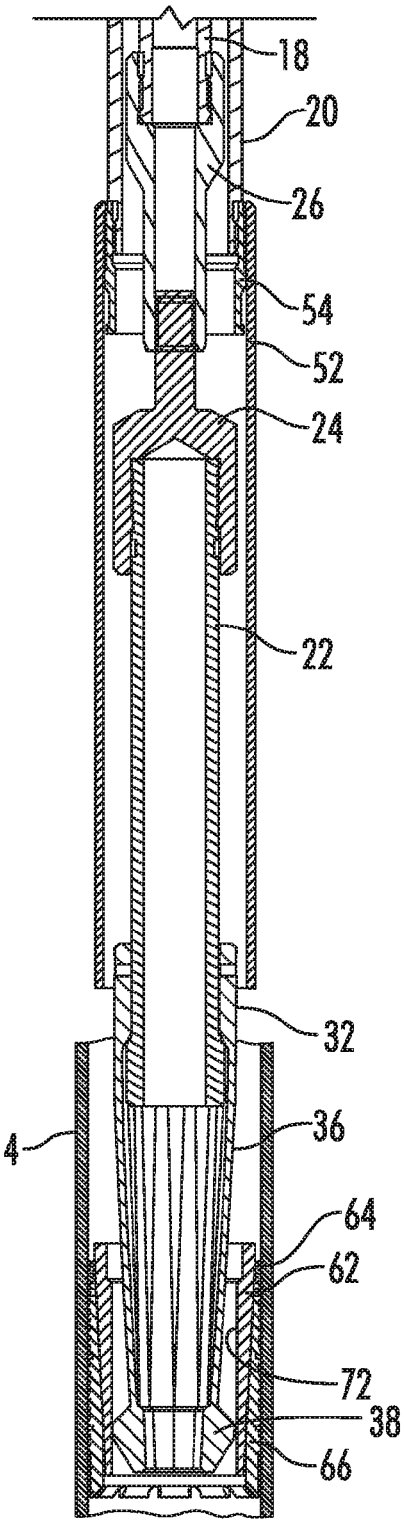

FIG. 16 shows a later stage of releasing and withdrawing adapter kit 14 where mandrel 22 has pulled release sleeve 32 upward and partially out of set plug 16. That is, once mandrel 22 engages release sleeve 32 it will pull release sleeve 32 up with it. Downward facing tapered lower surface 124 on the lower end 98 of slip 66 and upward facing setting surface portions 58 of collet heads 38 have complementary angles. Thus, upward motion of release sleeve 32 will cause collet heads 38 to cam radially inward. Release sleeve 32 is thereby released from lateral engagement with slip 66 and can travel upward through inner bore 72 of wedge 62.

Thus, it will be noted that in FIG. 16 release sleeve 32 has traveled upward and partially through plug 16. Setting tool 12 then can be pulled further out of liner 4 via setting tool inner part 18 or wireline 15 such that adapter kit 14 and, in particular, release sleeve 32 eventually is pulled completely out of plug 16. Plug 16 then will be fully installed as depicted in FIG. 3 and will be ready to receive frac ball 76 as depicted in FIG. 4. It will be noted that when adapter kit 14 has been removed from plug 16, inner bore 72 of wedge 62 provides a relatively large conduit and is free of any structures substantially restricting the flow of production fluids up through plug 16.

Assembly of Preferred Tool String

Preparing setting tool 12, adapter kit 14, and plug 16 for deployment into well 1 is perhaps best visualized by reference to FIG. 11. First, setting tool adapter 26 is threaded on to the lower end of inner part 18 of setting tool. The threaded connection 132 may be secured by one or more set screws (not shown).

Next, adjusting sleeve 54 is threaded to the lower end of the outer part 20 of setting tool 12 and setting sleeve 52 is threaded onto adjusting sleeve 54. The threaded connection 130 between adjusting sleeve 54 and setting tool outer part 20 may be secured by one or more set screws (not shown). The threaded connection 134 between setting sleeve 52 and adjusting sleeve 54 is configured such that it may be completely overrun by setting sleeve 52. When setting sleeve 52 overruns threaded connection 134 it is free to slide upward past adjusting sleeve 54.

Mandrel 22 of adapter kit 14 then is inserted upwards through release sleeve 32 and top cap 24 is threaded on to the upper end of mandrel 22. Threaded connection 126 between top cap 24 and mandrel 22 preferably is secured by one or more set screws 128. Shear pins 48 then are installed through bores 50 in release sleeve 32 and into groove 46 of mandrel 22 to frangibly connect release sleeve 32 to mandrel 22.

Figure 18:
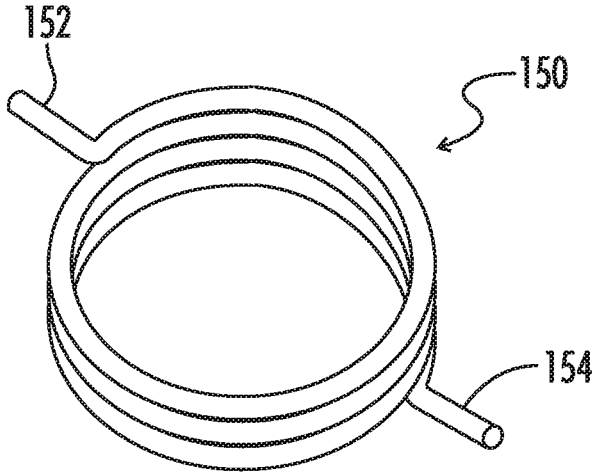
FIG. 18 is a perspective view of a tension mandrel lock spring 150 used in connecting certain components of adapter kit 14.

The subassembly of mandrel 22, release sleeve 32, and top cap 24 then is inserted upward through the bore of plug 16 such that setting surface portions 58 of collet heads 38 bear on mating lower surface 124 of slip 66. That subassembly, in turn, is connected to setting tool 12 by first sliding setting sleeve 52 upward and past adjusting sleeve 54, thereby allowing access to setting tool adaptor 26. Tension lock spring 150 then is inserted around the upper end of top cap 24, and top cap 24 is threaded into adapter 26. Threaded connection 136 between top cap 24 and adapter 26 may be secured by one or more set screws (not shown). Tension lock spring 150 also helps to prevent rotation between top cap 24 and adapter 26. As shown in FIG. 18, lock spring 150 has upper and lower end prongs 152 and 154 which engage radial recesses (not shown) in the lower end of adapter 26 and in the upward facing shoulder of top cap 24.

Finally, setting sleeve 52 is slid back down over adjusting sleeve 54 toward wedge 62 of plug 16. Once it again engages threaded connection 134 with adjusting sleeve 54, setting sleeve 52 is rotated about threaded connection 134 to move it downward until its lower end 56 engages the upper end 68 of wedge 62. Setting sleeve 12, adapter kit 14, and plug 16 are now ready for deployment.

Overview of Second Preferred Plug

A second preferred embodiment 216 of the novel plugs is illustrated in FIGS. 19-33. Second preferred plugs 216 may be used to perform "plug and perf" fracturing operations in substantially the same manner as described above for first preferred plugs 16 and schematic FIG. 1. Plug 216 may be connected to setting tool 12 via an adapter kit 214. Those tools then will be deployed into well 1 along with perf gun 11 via wireline 15. Setting tool 12 will be actuated to install plug 216 in liner 4 and to release adapter kit 214 from plug 216. Perf gun then will be actuated to perforate liner 4, after which perf gun 11, setting tool 12, and adapter kit 214 will be pulled out of well 1 by wireline 15. Fluid will be pumped into liner 4 to establish fractures 9 adjacent the perforations. The plugging and perfing will be repeated until fractures 9 have been established in formation 6 along the length of liner 4.

Figure 19:
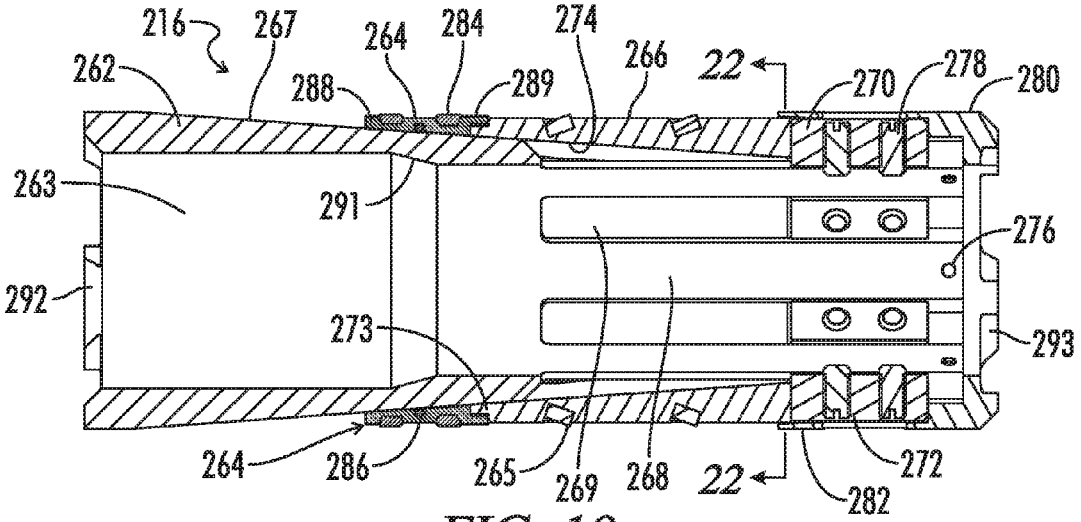
FIG. 19 is an enlarged axial cross-sectional view of a second preferred embodiment 216 of plug assemblies of the subject invention. Plug 216 is shown in its run-in state, and the figure omits for the sake of clarity certain components of an adapter kit 214.
Figure 20:
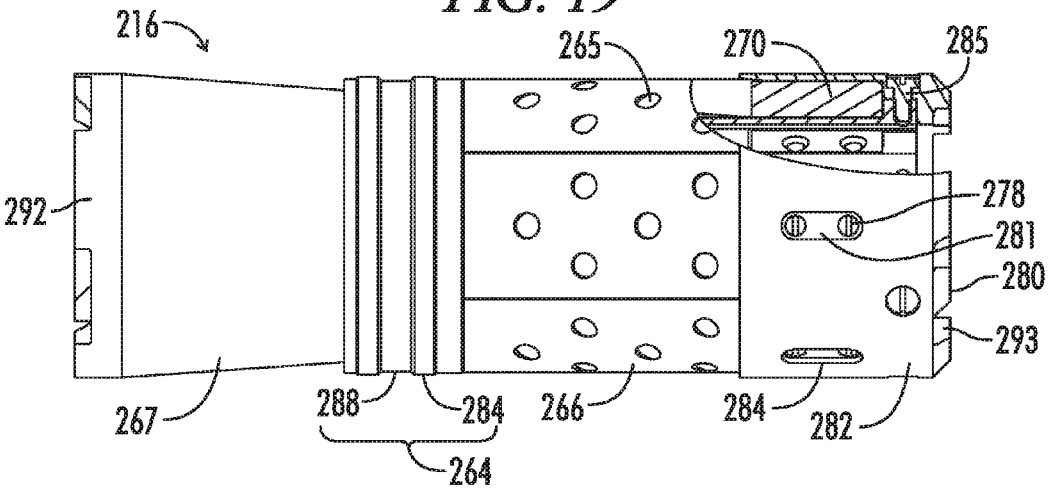
FIG. 20 is side elevational view, including a partial cut-away axial cross-section, of plug 216. Plug 216 is shown in its run-in state, and the figure omits for the sake of clarity certain components of adapter kit 214.
Figure 21:
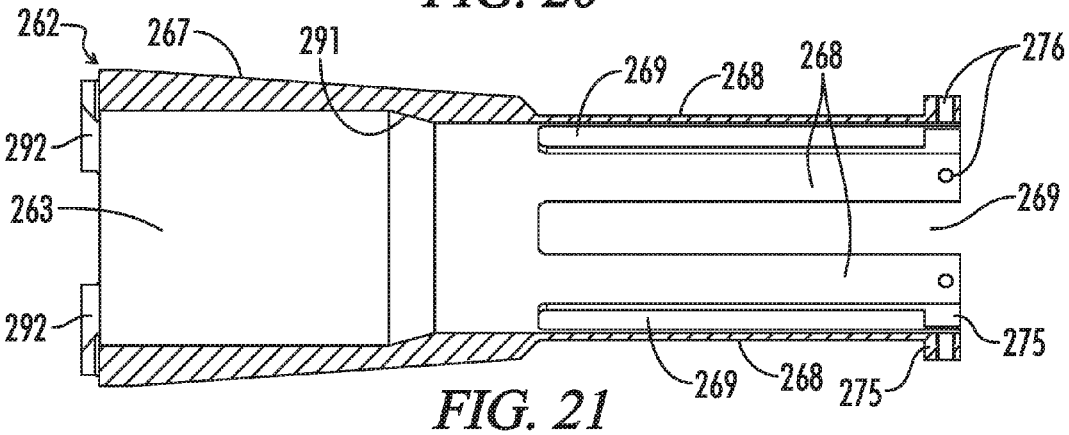
FIG. 21 is an axial cross-sectional view of an annular wedge 262 of plug 216.
Figure 22:
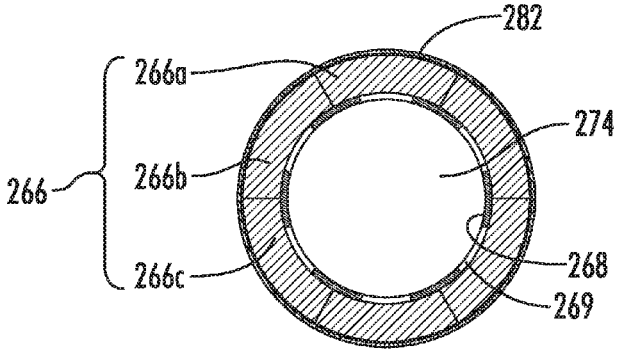
FIG. 22 is a radial cross-section view, taken generally along lines 22-22 of FIG. 19, of plug 216.
Figure 23:
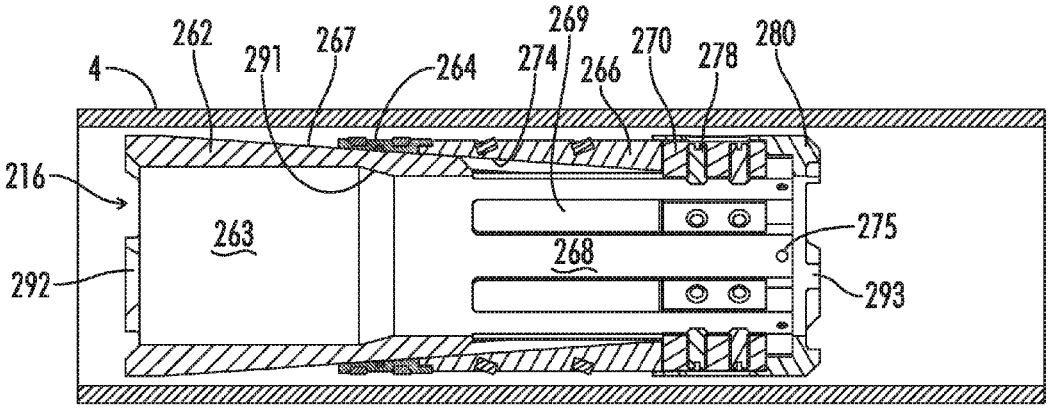
FIGS. 23 and 24 are sequential axial cross-sectional views of plug 216 in liner 4 omitting, for the sake of clarity, various components of adapter kit 214.

As seen best in FIGS. 19-20 and 23, which show plug 216 in its run-in state, plug 216 generally comprises an annular wedge 262, a sealing ring 264, an annular slip 266, a setting ring 270, and a gauge ring 280. Annular wedge 262 is shown in isolation in FIG. 21. As seen therein, wedge 262 is similar in respects to wedge 62 of plug 16. Wedge 262 also may be described in general terms as having an annular or open cylindrical shape. The upper portion of wedge 262 is generally tapered, but in contrast to wedge 62, the lower portion of wedge 262 comprises a plurality of collet fingers 268.

Collet fingers 268 are integrally formed with wedge 262 and extend axially downward from the lower end of the wedge upper portion. Collet fingers 268 are spaced circumferentially around annular wedge 262 and terminate in collet heads 275. As will be appreciated from the discussion that follows, collet fingers 268 provide support for slip 266 as it is assembled and a base for connecting gage ring 280.

Wedge 262 also has an axial passage or bore 263 extending through its upper portion. An inner ball seat 291 is defined in wedge bore 263, bore 263 otherwise having a substantially uniform diameter.

The upper portion of wedge 262 has an outer, generally truncated inverted conical surface 267. That is, outer conical surface 267 tapers downwardly and inwardly, and the diameter of its upper end is greater than the diameter of its lower end. The upper end of wedge 262 may have, as does wedge 62 of plug 16, a substantially cylindrical outer surface if desired. That is, conical surface 267 does not necessarily extend all the way to the upper end of wedge 262. Preferably, however, it extends along the substantially majority of the upper portion of wedge 262.

As best appreciated from FIGS. 19-20, sealing ring 264 of plug 216 is quite similar to sealing ring 64 in plug 16. Sealing ring 264 has a relatively short, annular body 288 defining an axial passage or bore. The ring bore has a generally inverted truncated conical shape, that is, it tapers radially outward from its lower end to its upper end. The inner taper of the bore of sealing ring 264 is complementary to the taper provided on outer conical surface 267 of wedge 262. Sealing ring 264 preferably is provided with one or more elastomeric seals which ultimately will enhance the seal between plug 216 and liner 4 when plug 216 is set. Thus, ring body 288 is provided with one or more outer elastomeric seals 284 in corresponding grooves on the outer surface of ring body 288. One or more inner elastomeric seals 286 are provided in corresponding grooves in the ring bore. Other seal configurations may be used, however, or the seals may be eliminated depending on the design of the sealing ring and the materials from which it is fabricated.

Slip 266 of plug 216, like slip 66 of plug 16, is designed to grip and engage liner 4. Slip 66, however, is a breakaway slip designed to break apart into several segments. In contrast, slip 266 of plug 216 is an assembly of discrete, separate slip segments. More specifically, slip 266 has six individual slip segments **266*a* to 266*f*. Individual slip segments 266*a-f* may be visualized as a lateral segment of an open cylinder. When plug 216 is in its run-in condition, as best appreciated from FIGS. 20 and 22, segments 266*a-f* are aligned along, and arranged angularly about the tool axis. Preferably, slip segments 266*a-f* are closely adjacent or abut each other. Thus, slip segments 266*a-f* collectively define an open cylindrical slip 266 having an axial inner passage or bore 274**.

Bore 274 of slip 266 has a generally truncated inverted conical surface. That is, slip bore 274 tapers radially inward from top to bottom, and the diameter of slip bore 274 at its upper end is greater than the diameter at its lower end. Preferably the taper in slip bore 274 is complementary to the taper on outer conical surface 267 of the upper portion of wedge 262.

The outer surface of slip 266 is generally cylindrical. Preferably, it is provided with features to assist slip 266 in engaging and gripping liner 4 when plug 216 is set. Thus, for example, slip 266 may be provided with high-strength or hardened particles, grit or inserts, such as buttons 265 embedded in its outer surface. Buttons 265 may be, for example, a ceramic material containing aluminum, such as a fused alumina or sintered bauxite, or zirconia, such as CeramaZirc available from Precision Ceramics. Buttons also may be fabricated from heat treated steel or cast iron, fused or sintered high-strength materials, or a carbide such as tungsten carbide. The precise number and arrangement of buttons 265 or other such members may be varied. The outer surface of slip 266 also may be provided with teeth or serrations in addition to or in lieu of buttons or other gripping features.

Figure 24:
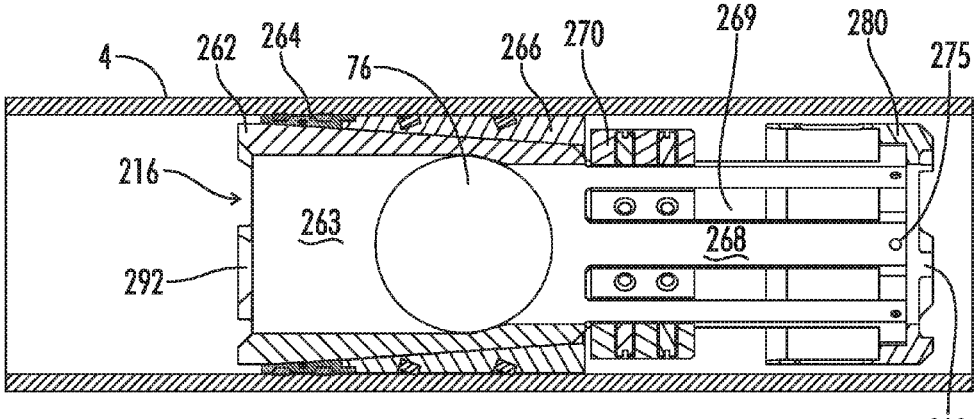

In general terms, plug 216 will be set in liner 4 in the same manner as is plug 16. Annular wedge 262 will be driven into sealing ring 264 and annular slip 266. As wedge 262 is driven downward, it will force sealing ring 264 and slip 266 to expand and seal and anchor 216 in liner 4. The operation of plug 216 may be understood in greater detail by comparing FIGS. 19-20 and 23 with FIG. 24. FIGS. 19-20 and 23 show plug 216 in its run-in condition. FIG. 24 shows plug 216 after it has been set in liner 4 and frac ball 76 has seated in plug 216 to isolate lower portions of liner 4.

As shown in FIGS. 19-20 and 23, when plug 216 is assembled for running into a well, slip 266 is disposed generally around collet fingers 268 of wedge 262 with the upper end of slip 266 extending over the lower portion of outer conical surface 267 of wedge 262. Outer conical surface 267 of wedge 262 thus is received in and engages conical bore 274 of slip 266.

Sealing ring 265 is carried on outer conical surface 267 of wedge 262 near its lower end such that it abuts the upper end of slip 266. Slip segments **266*a-f* preferably are secured at their upper ends. Thus, for example, the lower end of sealing ring 264 is provided with an annular projection or lip 289. Slip segments 266*a-f* have a complementary lip 273 on their upper ends. Sealing ring lip 289 and slip lip 273 engage each other, thus securing the upper end of slip 266**.

Collet fingers 268 extend downward through slip bore 274 and terminate beyond the lower end of slip 266. Setting ring 270 is carried slidably around that lower portion of collet fingers 268. More particularly, the upper end of setting ring 270 abuts the lower end of slip 266 and the lower end of setting ring 270 abuts heads 275 of collet fingers 268 and an upward facing shoulder on gauge ring 280.

Figure 25:
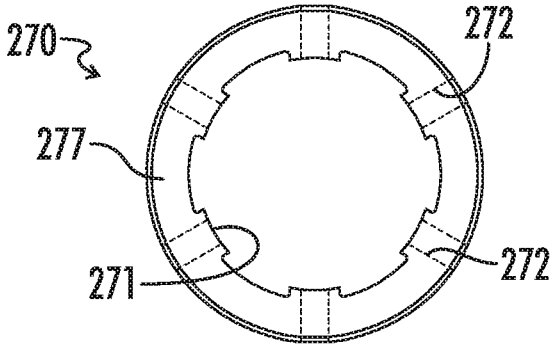
FIG. 25 is a top elevational view of a setting ring 270 of plug 216.
Figure 26:
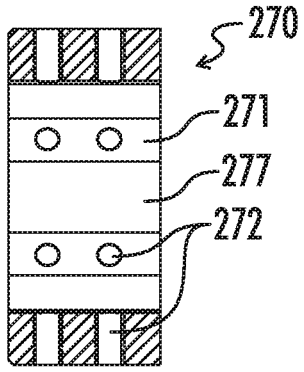
FIG. 26 is an axial cross-sectional view of setting ring 270 shown in FIG. 25.
Figure 27:
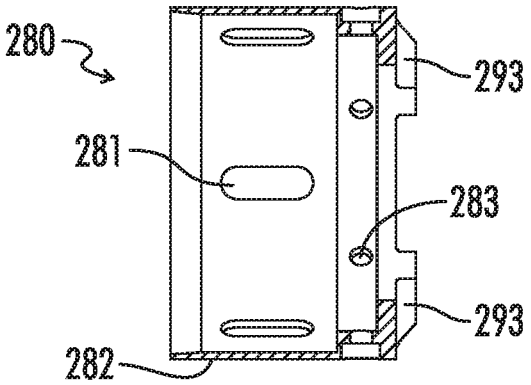
FIG. 27 is an axial cross-sectional view of a gauge ring 280 of plug 216.
Figure 28:
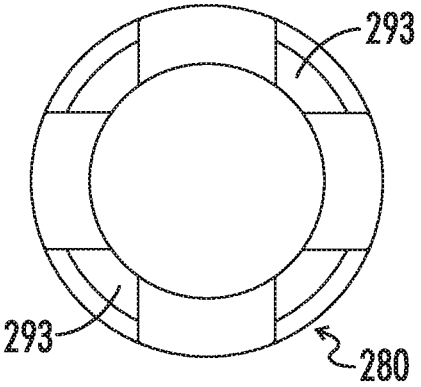
FIG. 28 is a bottom elevational view of gauge ring 280 shown in FIG. 27.

Setting ring 270 is shown in isolation in FIGS. 25-26. As shown therein, setting ring 270 has a generally annular body 277 having a plurality of keys 271. Keys 271 are arranged circumferentially on the inner surface or bore of setting ring body 277 and protrude radially inward. Setting ring 270 is slidably carried around the lower portion of collet fingers 268 such that keys 271 on setting ring 270 extend inward into slots 269 between collet fingers 268.

As shown in FIGS. 19-20 and 23, gauge ring 280 may be viewed as a bottom cap for plug 216. It is attached to the lower end of collet fingers 268 and extends generally around setting ring 270 and the lower end of slip 266. More particularly, and referring to those figures and to FIGS. 27-28 which show gauge ring 280 in isolation, it will be appreciated that the lower portion of gauge ring 280 is generally enlarged and fits around and below heads 275 of collet fingers 268. Gauge ring 280 may be connected to heads 275 of collet fingers 268, for example, by fasteners 285 shown in FIG. 20. Fasteners 285 may be screws, bolts, or pins inserted through radial holes 283 in the lower portion of gauge ring 280 (see FIG. 27) into radial holes 276 provide in collet heads 275 (see FIG. 21).

Gauge ring 280 also has a relatively thin upper perimeter wall or skirt 282 extending upwardly from its lower portion. Skirt 282 extends upwardly beyond setting ring 270 and terminates just beyond the lower end of slip 266. Gauge ring 280 and, in particular, skirt 282 is thus able to hold the lower portions of slip segments 266*a-f* together in a close annular arrangement.

Gauge ring 280 also helps protect the lower end of plug 216 as it is deployed into a well. Skirt 266 of gauge ring 280 extends around the lower portions of slip segments 266*a-f*, thus helping to protect them from catching on debris, protrusions, and the like that might cause them to deploy prematurely. It also will be noted that the outer diameter of gauge ring 280 is greater than the outer diameter of the setting ring 270, slips 266, sealing ring 264, and the upper portion of wedge 266. More particularly, the outer diameter of gauge ring 280, relative to the inner walls of liner 4, is such that it presents a leading edge sufficient to prevent plug 216 from being lowered into constrictions in liner 4 that are too narrow to allow passage of plug 216. Preferably, the tolerances are such that it provides sufficient clearance for plug 216 to be lowered past more typically encountered obstructions, protrusions, and bends in liner 4 without catching or damage.

Figure 29:
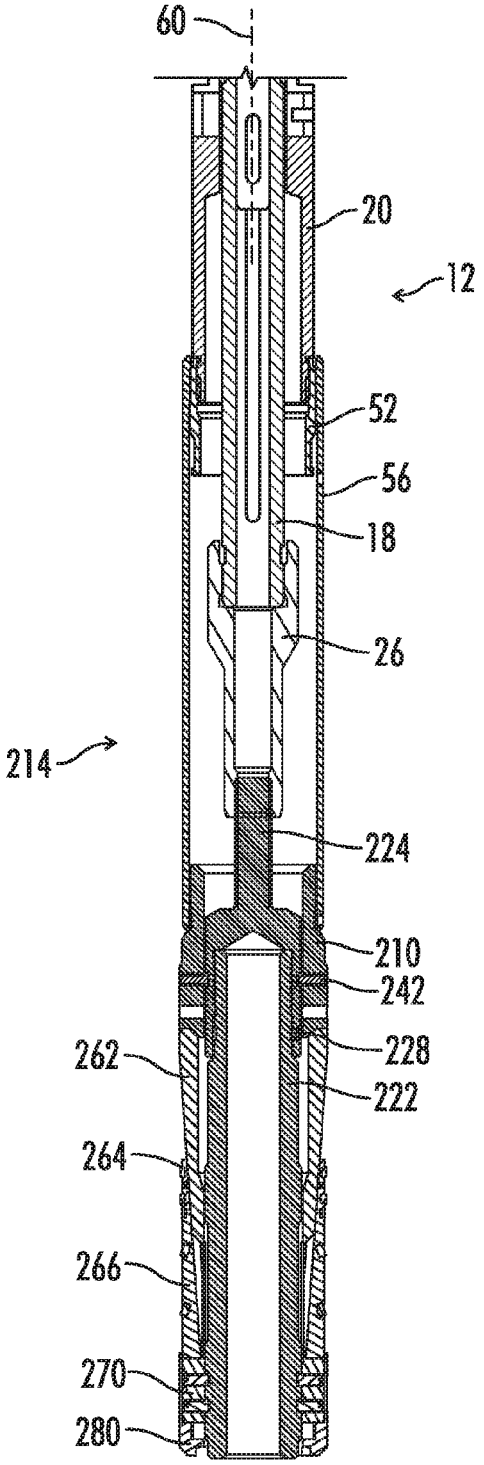
FIG. 29 is an axial cross-sectional view, similar to the view of FIG. 12, showing portions of setting tool 12 and adapter kit 214 with plug 216. Setting tool 12, adapter kit 214, and plug 216 are in their unactuated, run-in state.
Figure 30:
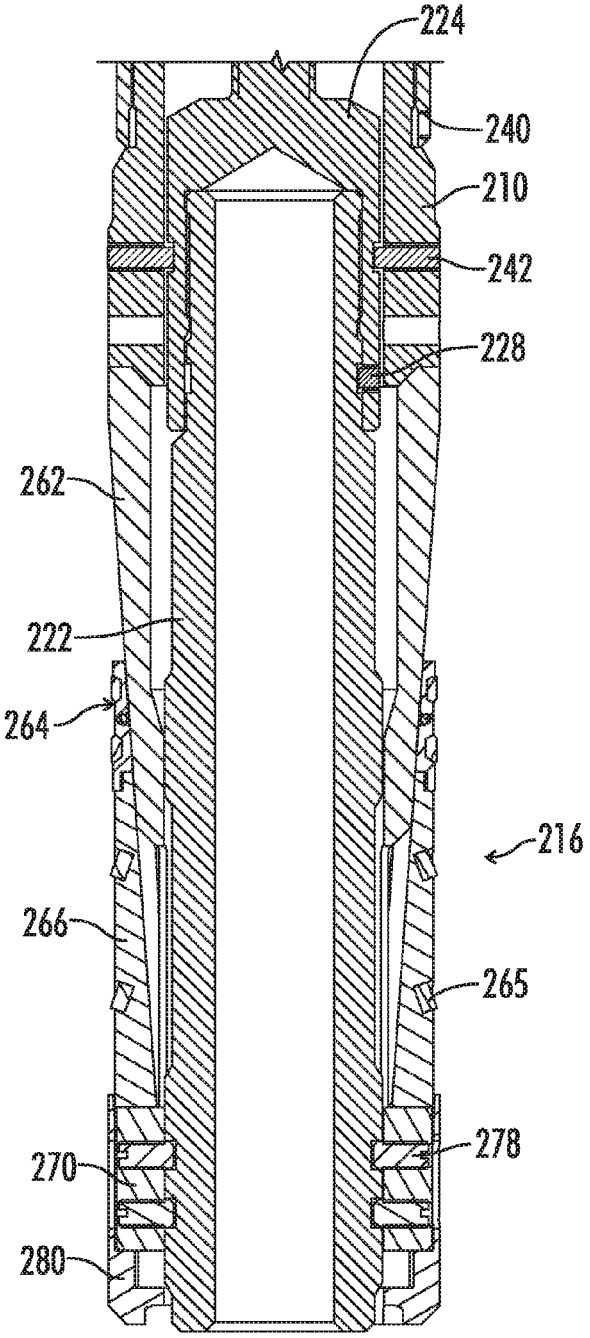
FIG. 30 is an enlarged axial cross-sectional view of adapter kit 214 and plug 216 shown in FIG. 29.
Figure 31:
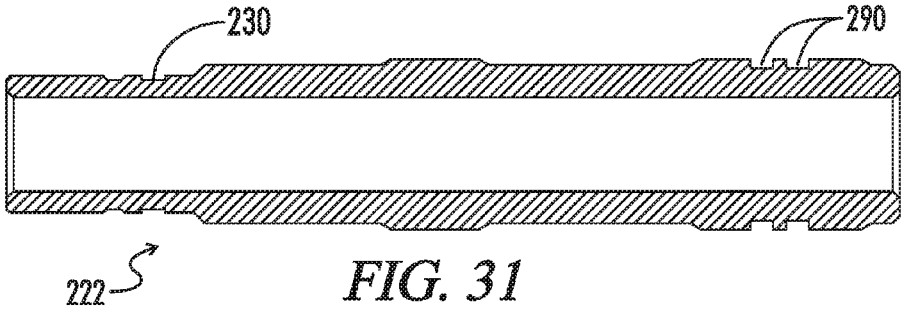
FIG. 31 is an axial cross-sectional view of an actuating mandrel 222 of adapter kit 214.
Figure 32:
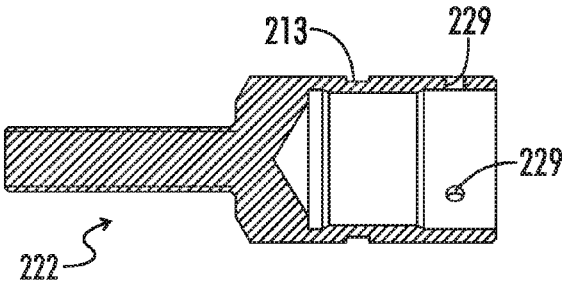
FIG. 32 is an axial cross-sectional view of a top cap 224 of adapter kit 214.
Figure 33:
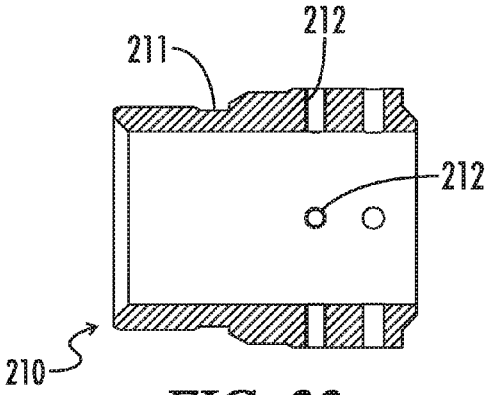
FIG. 33 is an axial cross-sectional view of a sleeve adapter 210 of adapter kit 214.

Plug 216 may be deployed and installed in much the same manner as plug 16. As shown in FIGS. 29-30, plug 216 is coupled at its upper end to setting tool 12 and adapter kit 214. Setting tool 12, as noted above, includes inner part 18 and outer part 20. When actuated, outer part 20 moves downward relative to inner part 18 and transmits force through adapter kit 214 to plug 216.

Adapter kit 214 generally includes setting tool adapter 26, a top cap 224, an actuating mandrel 222, adjusting sleeve 54, outer setting sleeve 52, and a sleeve adapter 210. Adapter 26, top cap 224, and actuating mandrel 222 in general serve to releasably connect plug 216 to inner part 18 of setting tool 12. Adjusting sleeve 54, outer setting sleeve 52, and sleeve adapter 210 serve generally to transmit downward movement of setting tool outer part 20 to plug 216.

Actuating mandrel 222 of adapter kit 214 has a generally open cylindrical shape. As shown in FIG. 29, it is connected to the lower end of setting tool inner part 18 by setting tool adapter 26 and top cap 224. Mandrel 222 is releasably connected at its lower end to plug 216. As described further below, that releasable connection allows plug 216 to be set and ultimately allows setting tool 12 and adapter kit 214 to be released and withdrawn from plug 216.

More particularly, when plug 216 is run into a well mandrel 222 is releasably connected to setting ring 270 of plug 216 by a plurality of frangible fasteners 278. Frangible shear screws 278 extend through threaded radial holes 272 (see FIGS. 25-26) in keys 271 of setting ring 270 and into recesses such as grooves 290 (see FIG. 31) at the lower end of mandrel 222. Shear screws 278 will be designed to break at a desired shear force and thereby release mandrel 222 from plug 216 after it has been installed in liner 4. Other frangible connectors, such as pins, may be used for such purposes. Similarly, instead of grooves 290, mandrel 222 may be provided with a series of detents, spotfaces, or holes.

As noted above, outer setting sleeve 52 of adapter kit 214 is connected at its upper end to the lower end of outer part 20 of setting tool 12 via adjusting sleeve 54. The lower end of outer setting sleeve 52 abuts and is connected to sleeve adapter 210. For example, the upper end of sleeve adapter 210 may be threaded into the lower end of outer setting sleeve 52. Set screws or the like (not shown) may extend through radial holes 240 in the lower end of outer setting sleeve 52 and into holes, a groove, or other outer recess 211 in sleeve adapter 210 (see FIG. 33).

Sleeve adapter 210 is slidably carried about the lower, enlarged end of top cap 224. When plug 216 is in its run-in state, however, sleeve adapter 210 and top cap 224 are releasably restricted from relative movement. Thus, for example, frangible screws, pins, or other suitable connectors 242 may extend through radial holes 212 in the lower end of sleeve adapter 210 and into a groove 213 or other detents, spotfaces, or holes machined into the outer surface of top cap 224 (see FIG. 32). As described further below, the releasable connection between sleeve adapter 210 and top cap 224 prevents plug 216 from being set prematurely as it is run into a well, but it can be broken after plug 216 is deployed to allow plug 216 to be installed.

Once coupled to adapter kit 214 and setting tool 12, plug 216 may be deployed and installed in a well. Though there are differences in the operation, plug 216 will be installed in liner 4 generally in the same manner as is plug 16. Annular wedge 262 will be driven into sealing ring 264 and annular slip 266 to force sealing ring 264 and slip 266 to expand and set and seal plug 216 in liner 4 as shown in FIG. 24.

More particularly, once plug 216 is deployed to the desired location in liner 4, setting tool 12 will be actuated. Once a predetermined force is generated within setting tool 12, the frangible connection between sleeve adapter 210 and top cap 224 of adapter kit 214 will be broken. Setting tool outer part 20, adjusting sleeve 54, outer setting sleeve 52, and sleeve adapter 210 then are able to move downward relative to setting tool inner part 18, setting tool adapter 26, top cap 224, and mandrel 222.

Sleeve adapter 210 bears down on the upper end of wedge 262 which, as noted above, carries sealing ring 264 and extends through slip 266 and setting ring 270. Sealing ring 264 abuts the upper end of slip 266, and setting ring 270 abuts the lower end of slip 266. Setting ring 270 is held in position by mandrel 222, to which it is connected by frangible fasteners 278. Collet fingers 268 of wedge 262, however, are able to slide freely within the bore of setting ring 270. That will allow plug 216 to be installed, in essence, by compressing wedge 262, sealing ring 264, and slip 266 together between sleeve adapter 210 and setting ring 270.

More particularly, wedge 262 will be driven downward into sealing ring 264 and slip 266. As wedge 262 travels axially downward, the complementary conical surfaces on the upper portion of wedge 262 and in the bore of sealing ring 265 and bore 274 of slip 266 allow wedge 262 to ride under sealing ring 264 and slip 266. As wedge 262 rides under sealing ring 264 and slip 266, it forces them to expand radially.

In accordance with a preferred aspect of the subject invention, body 288 of sealing ring 264 is fabricated from a sufficiently ductile material to allow sealing ring 264 to expand radially into contact with liner 4 without breaking. As sealing ring 264 expands radially, outer elastomeric seal 284 seals against liner 4 and the inner elastomeric seal 286 seals against the outer conical surface 267 of wedge 262. Sealing ring 264 is thus able to provide a seal between plug 216 and liner 4.

As slip 266 is expanded radially by wedge 262, slip segments 266*a-f* will be forced radially outward and eventually into contact with liner 4. Thus jammed between outer conical surface 267 of wedge 262 and liner 4, they are able to anchor plug 216 within liner 4. Upper end of slip 266 abuts the lower end of sealing ring 264, thus also providing hard backup for sealing ring 264 as it expands radially to seal against liner 4.

As noted above, mandrel 222 is releasably connected to setting ring 270 by frangible fasteners 278. When wedge 262 has been fully driven into sealing ring 264 and slip 266, a downward facing, beveled shoulder at the lower end of upper portion of wedge 262 will engage setting ring 270. Sealing ring 264 and slip 266 also will have been expanded into engagement with liner 4. At that point the shear forces across frangible fasteners 278 will increase rapidly. When those forces exceed a predetermine limit, frangible fasteners 278 will shear, relieving any further compressive force on plug 216. Shearing of fasteners 278 also releases mandrel 222 from setting ring 270. Inner part 18 of setting tool 12 will continue its stroke, pulling mandrel 222 upward. Preferably, the stoke of setting tool 12 will be such that mandrel 222 is withdrawn to a point where its lower end is within the enlarged diameter portion of wedge bore 263 above ball seat 291. Adapter kit 214 and setting tool 12 then can be pulled out of plug 216 and liner 4 via wireline 15.

FIG. 24 shows plug 216 after it has been installed in liner 4 and frac ball 76 has been deployed. Frac ball 76 has landed on seat 291 in bore 263 of wedge 262. Seat 291 has a beveled surface which allows ball 76 to substantially restrict or preferably to shut off fluid flow through plug 216, thereby substantially isolating portions of well 1 below plug 216. Preferably, when plug 216 is installed, seat 291 will be located at a level between the upper and lower ends of slip 266.

For example, as appreciated from FIG. 24, seat 291 is situated within bore 263 of wedge 262 such that when wedge 262 has been driven fully downward it is disposed below the mid-point of slip 266 and well below sealing ring 264. Thus, when fluid is pumped into liner 4 hydraulic pressure will build not only against frac ball 76, but also within a substantial portion of wedge bore 263. The hydraulic pressure within wedge bore 263 will bear radially outward through wedge 262, thereby enhancing the seal between sealing ring 264 and liner 4 as well as the engagement of slip 266 with liner 4. The shallow bevel on ball seat 291 also allows ball 76 to transmit a substantial portion of the hydraulic pressure applied to it radially outward through wedge 262 to slip segments 266*a-f*, further enhancing the anchoring of plug 216 in liner 4.

As described above with respect to plug 16, various modifications may be made to illustrative plug 216. Other closure devices and arrangements may be provided. Standing valves and non-spherical closure devices may be used. Wedge 264 may have a break-away configuration, or it may be configured to provide discrete ramped surfaces.

Plug 216 also may be fabricated from materials typically used in plugs of this type, and preferably will be softer, more easily drilled materials. Wedge 262 and slip 266, for example, preferably are machined from wound fiber resin blanks, such as a wound fiberglass cylinder. Body 288 of sealing ring 264 also preferably is fabricated from a ductile material, especially ductile plastics as described above for sealing ring 64.

Plug 216 can be assembled from its component parts and prepared for deployment into liner 4 as follows. First, setting tool adapter 26 is threaded on to the lower end of inner part 18 of setting tool, adjusting sleeve 54 is threaded to the lower end of the outer part 20 of setting tool 12, and setting sleeve 52 is threaded onto adjusting sleeve 54, all as described above in relation to plug 16. Next, sleeve adapter 210 may be threaded into the lower end of outer setting sleeve 52.

Plug 216 then may be assembled in an upside-down fashion. Specifically, annular wedge 262 may be inverted with collet fingers 268 pointing up. Sealing ring 264, with ring lip 289 facing up, then is passed over collet heads 275 and slid down onto outer surface 267 of wedge 262. With sealing ring 264 resting on wedge 262, slip segments 266*a-f* then may be loaded (upside down) around wedge 262 such that lip 273 of each segment 266*a-f* engages lip 289 of sealing ring 264. Setting ring 270 then is passed (upside down) over collet heads 275 and slid down wedge 262 with ring keys 271 traveling through slots 269 between collet fingers 268 until it abuts slip segments 266*a-f*. Gauge ring 280 then can be connected to heads 275 of collet fingers 268, for example, by fasteners 285. Skirt 282 of gauge ring 280 will extend around and past setting ring 270 such that it is able to hold slip segments 266*a-f* in their annular arrangement. Plug 216 now is ready for attachment to adapter kit 214 and, thereby, to setting tool 12.

First, mandrel 222 is releasably connected to plug 216. Specifically, top cap 224 is threaded onto mandrel 222 as described above for plug 16. The threaded connection preferably is secured, e.g., by set screws 228 or the like as may be inserted through radial holes 229 in top cap 224 and into groove 230 on mandrel 222. Mandrel 222 then is inserted into bore 263 of wedge 262 such that grooves 290 at the lower end of mandrel 222 are aligned with radial holes 272 in keys 271 of setting ring 270. Frangible shear screws 278 then are screwed into setting ring holes 272 and into mandrel grooves 290. It will be noted that gauge ring 280 is provided with openings 281 seen best in FIG. 27. Openings 281 allow sighting and alignment of setting ring holes 272 and mandrel grooves 290 and insertion of shear screws 278.

Setting sleeve 52 and sleeve adapter 224 then can be raised to allow access to setting tool adapter 26. Top cap 224 now can be threaded into setting tool adapter 26 as described above in relative to plug 16. Finally, setting sleeve 52 and sleeve adapter 224 are slid downward until the lower end of sleeve adapter 224 abuts the upper end of wedge 262. Sleeve adapter 210 then is releasably connected to top cap 224 by frangible connectors 240 extending through radial holes 212 in the lower end of sleeve adapter 210. Setting tool 12, adapter kit 224, and plug 216 now are ready for deployment into a well.

It will be appreciated from the foregoing description of preferred plugs 16 and 216 that the novel plugs share certain general features with prior art plug designs, but in general incorporate fewer parts. They rely on three primary components, a wedge, a sealing ring, and a slip, and design features which allow those three components to perform the essential functions of sealing and anchoring the plug. They do not rely on a central support component, such as a support mandrel, to support the wedge, sealing element, and slips as do conventional plugs, either during setting of the plug or after it has been installed. Instead, as described further below, the wedge in the novel plugs is self-supporting, and the wedge provides the support for the sealing ring and slip. No special backup rings, as are common in conventional plugs, are required to protect the sealing ring against extrusion. The slips in the novel plugs provide a dual function of anchoring the plug and providing a hard backup for the sealing ring. Thus, in general, they may be more easily and economically fabricated and assembled.

Moreover, primarily because they do not incorporate a support mandrel, the novel plugs may have a relatively large central bore. The central bore also is free of any structure which might substantially restrict flow of production fluids up through the plug. Thus, the novel plugs may allow an operator to use dissolvable frac balls. After the balls dissolve, the well may be produced without the considerable time and expense of drilling out the plugs. The novel plugs also may facilitate unexpected remedial operations which must be performed through the plug before it is removed.

For a given liner size, the central bore in the wedge and slip of the novel plugs will be larger than the central passageway in the support mandrel of conventional designs. Thus, by essentially eliminating the support mandrel, the novel plugs provide a central passageway for fluids which is relatively larger. For example, conventional plugs for installation in a 5.5" liner typically will have a central passageway through the support mandrel of approximately 1" in diameter. In contrast, the novel plugs may have an internal diameter of approximately 3".

The large central bore relative to the length of the wedge and the overall length of the plug is particularly important when the wedge and slip are fabricated from drillable composites such as wound fiberglass. Wound fiberglass has fibrous cords which are wound around a cylindrical core and impregnated with resin. Manufacturers have developed various winding patterns designed to minimize this, but such materials are particularly susceptible to axial shear stress. They may be visualized as having a spiral shear plane running axially through the part, with the inner portions of the spiral being the weakest. Thus, when pressure is applied behind a seated ball, shear forces will be transmitted axially into the part through the seat. Excessive pressure can "blow" the ball through the part, essentially shearing away internal layers of the bore.

In conventional designs, the ball seat is provided in a relatively smaller bore of a support mandrel. The shear forces, therefore, will be applied through a smaller circumference where the support mandrel is more susceptible to shearing. In order to compensate for the relative weakness of the support mandrel, the support mandrel typically will be relatively elongated. The proportionally greater length provides the requisite resistance to shearing.

In contrast, the shallow bevel on ball seat 74/291 in plug 16/216 allows shortening of the parts. That is, the shallow bevel on ball seat 74/291 allows ball 76 to transmit a substantial portion of the hydraulic pressure applied to it radially outward. That not only enhances sealing and anchoring of plug 16/216, as discussed above, but it also means that a smaller vector component of the force applied to ball 76 is transmitted axially to wedge 62/262. Those parts may be made shorter as the amount of shear stress which they must resist is reduced. Accordingly, the novel plugs will have ball seats wherein the bevel is from about 10° to about 30°, preferably about 15° off center.

It will be appreciated that it is possible for the novel plugs to eliminate the support mandrel typically incorporated into conventional plugs primarily because of the taper applied to the wedge and slip and the location of the ball seat within the wedge. For example, the taper angle on wedges 62/262 and slips 66/266 in plugs 16/216 is relatively shallow. Preferably, the taper on the wedges and slips of the novel plugs is such that the wedges and slips are self-locking as opposed to self-releasing. With hard materials, such as steel, the upper limit for self-locking tapers is about 7°. With softer, more elastic materials, such as the preferred composite materials, steeper taper angles still will be self-locking. Accordingly, when fabricated from preferred composite materials the taper on the wedges and slips typically will be from about 1° to about 10°, preferably about 4° off center. Conventional plugs typically incorporate wedges and slips where the mating taper is relatively steep, usually self-releasing. Thus, a relatively thick, strong support mandrel is required to back up the wedge and slip to ensure that they do not separate and, thereby, compromise the seal or anchor of the plug.

Locating the ball seat within the bore and below the upper end of the wedge also helps minimize the need for support otherwise provided by a support mandrel. For example, and regarding preferred plug 216, ball seat 291 is situated within bore 263 of wedge 262 well below the upper end of wedge 262. When wedge 262 is set, ball seat 291 is located below the axial midpoint of slip 266. Hydraulic pressure behind a seated ball 76, therefore, will build within and bear radially outward through wedge bore 72 providing support for wedge 262 which in turn will enhance the support provided by wedge 262 to both sealing ring 264 and slip 266.

Shorter plugs are more easily deployed into liners, especially deviated liners, and other factors being equal, may be drilled more quickly. Eliminating the support mandrel also helps to shorten the overall length of the novel plugs. The support mandrel typically is the longest component in conventional plugs. Conventional plugs also typically require a pair of wedges and slips in order to maintain the radial expansion of the elastomeric sealing element against the liner wall. In contrast, the novel plugs preferably incorporate a single wedge and slip. Moreover, the sealing ring, carried as it is on the wedge, adds no length to the novel plugs.

Though perhaps not as readily apparent, seating a ball within the wedge also can help shorten the length of the novel plugs. For example, the upper end of wedge 262 and the lower end of gage ring 280 may be provided with mating geometries, such as castellations 292 on wedge 262 and castellations 293 on gauge ring 280. Castellations 292/293 help minimize "spinning" and speed up drill out of a series of plugs 216. That is, if the remains of an upper plug 216 start to spin as material is drilled away, the bit will push the upper plug 216 down until the castellations 293 on the remnants of uphole plug 216 engage the castellations 292 on a still set, downhole plug 216. The remnants of plug 216 will stop spinning and may be drilled away.

The provision of castellations, bevels, or other mating geometries at the ends of plugs is well known. Many conventional plugs, however, locate the ball seat at the top of the support mandrel. A seated ball, therefore, actually serves as a bearing surface to encourage spinning of a plug remnant pushed down onto the ball. Other plugs may provide a ball seat within the support mandrel bore, but typically it is located above the level of the wedge. That placement essentially means that the support mandrel has been lengthened to allow mating geometric features to extend above the ball. In contrast, by locating ball seat 291 of plug 216 well inside wedge bore 263, mating geometries may be provided on wedge 262 with minimal or essentially no lengthening of wedge 262.

Indeed, it will be appreciated that the novel plugs may be drilled more easily and will produce less material than conventional frac plugs offering comparable performance, even conventional composite plugs. All of the components may be made of easily drillable composite materials or, in the case of the sealing ring, from plastics. As noted, the support mandrel is eliminated, eliminating what often is the single largest component in conventional composite plugs. The overall reduced dimensions of the novel plugs mean there is less material present in the plug. Especially when a large number of plugs must be drilled out, other factors being equal less material can mean much faster drilling times with far less debris which must be circulated out of the well.

For example, consider the Obsidian® frac plugs available from Halliburton and the Diamondback frac plugs available from Schlumberger. Those are all composite frac plugs like preferred embodiments of the subject invention. It will be appreciated that plug 216 sized for a 5.5" liner has only about 20% of the volume of material as in comparably sized Obsidian and Diamondback plugs.

Preferred embodiments of the sealing ring in the novel plugs also can facilitate drilling in two other ways. As compared to sealing elements in conventional plugs, sealing rings 64/264 in plugs 16/216 are much smaller and will produce less debris when drilled out. Sealing rings 64/264 are relatively small even when composed of more easily drilled plastic material instead of soft metals.

Sealing elements in conventional plugs, as well as plastic sealing rings 64/264 in novel plugs 16/216, are subject to extrusion if not when the plug is set, then when the plug is later exposed to hydraulic pressure during fracturing operations. That is, hydraulic pressure will bear down on the seal. That pressure can open up channels in the seal or even push the seal material out from around the plug. Thus, conventional plugs incorporate various backup rings which are designed to back up the sealing element and minimize extrusion.

Typically, backup rings are made of relatively thin, somewhat flimsy metal which still allows what is viewed as a manageable amount of extrusion. Manageable extrusion, in turn, necessarily means the sealing element must be somewhat larger and comprise more material. Having ring-like shapes, conventional backup rings also become entangled around a bit. Many such rings might be "gathered" by the bit as it works its way through multiple plugs.

Sealing rings 64/264 of novel plugs 16/216, however, even when made of plastic, comprise less ductile and, therefore, less extrudable material. Moreover, sealing rings 64/264 are provided with hard backup from slips 66/266. For example, when plug 216 is in its run-in condition, segments 266*a-f* are closely adjacent and preferably abut each other. Collectively, slip segments 266*a-f* define an open cylinder the upper end of which abuts the lower end of sealing ring 264. Segments 266*a-f*, therefore, provides continuous support for sealing ring 264 as wedge 262 starts to expand sealing ring 264 radially outward. Even when completely set, from a cross-sectional perspective, slip segments 266*a-f* have separated only a relatively short distance. Thus, slip segments 266*a-f* can provide near continuous, hard backup for sealing ring 264 and, thereby, minimize the likelihood of significant extrusion of sealing ring 264 during fracturing operations. Importantly, they do so without incorporating metallic backup rings which later can complicate drilling of plugs.

It also has been observed that due to the contact between the lower end of sealing ring 264 and the upper end of slip segments 266*a-f*, segments 266*a-f* expand radially more uniformly as wedge 262 is driven into segments 266*a-f*. It also will be appreciated that the inner and outer radii of slip segments 266*a-f* preferably are matched, respectively, with the outer radii of the upper portion of wedge 262 and the inner diameter of liner 4. Consequently, there is more uniformly distributed contact between slip segments 266*a-f* and the inner wall of line 4. In particular, the contact between buttons 265 will be more uniformly distributed around plug 216, and the degree of contact between each button 265 will be more uniform from button 265 to button 265.

Though described to a certain extent, it will be appreciated that novel plugs 16 and 216, along with setting tool 12 and adapter kits 14 and 214, along with other embodiments thereof, may incorporate additional shear screws and the like to immobilize components during assembly, shipping, or run-in of the plug. Additional set screws and the like may be provided to prevent unintentional disassembly. Other sealing elements may be provided between components, and various ports accommodating fluid flow around and through the assembly also may be provided. Such features are shown to a certain degree in the figures, but their design and use in tools such as the novel plugs is well known and well within the skill of workers in the art. In many respects, therefore, discussion of such features is omitted from this description of preferred embodiments.

Plugs 16 and 216 and other embodiments have been described as installed in a liner and, more specifically, a production liner used to fracture a well in various zones along the well bore. A "liner," however, can have a fairly specific meaning within the industry, as do "casing" and "tubing." In its narrow sense, a "casing" is generally considered to be a relatively large tubular conduit, usually greater than 4.5" in diameter, that extends into a well from the surface. A "liner" is generally considered to be a relatively large tubular conduit that does not extend from the surface of the well, and instead is supported within an existing casing or another liner. It is, in essence, a "casing" that does not extend from the surface. "Tubing" refers to a smaller tubular conduit, usually less than 4.5" in diameter. The novel plugs, however, are not limited in their application to liners as that term may be understood in its narrow sense. They may be used to advantage in liners, casings, tubing, and other tubular conduits or "tubulars" as are commonly employed in oil and gas wells.

Likewise, while the exemplified plugs are particularly useful in fracturing a formation and have been exemplified in that context, they may be used advantageously in other processes for stimulating production from a well. For example, an aqueous acid such as hydrochloric acid may be injected into a formation to clean up the formation and ultimately increase the flow of hydrocarbons into a well. In other cases, "stimulation" wells may be drilled near a "production" well. Water or other fluids then would be injected into the formation through the stimulation wells to drive hydrocarbons toward the production well. The novel plugs may be used in all such stimulation processes where it may be desirable to create and control fluid flow in defined zones through a well bore. Though fracturing a well bore is a common and important stimulation process, the novel plugs are not limited thereto.

The novel plugs also may incorporate additional closure devices. For example, a standing valve may be used to restrict passage through the wedge bore. Standing valves may be useful if it is necessary to pressure test a liner.

It also will be appreciated that the description references frac balls. Spherical balls are preferred, as they generally will be transported though tubulars and into engagement with downhole components with greater reliability. Other conventional plugs, darts, and the like which do not have a spherical shape, however, also may be used to occlude the wedge bore in the novel plugs. The configuration of the "ball" seats necessarily would be coordinated with the geometry of such devices. "Balls" as used herein, therefore, will be understood to include any of the various conventional closure devices that are commonly pumped down a well to occlude plugs, even if such devices are not spherical. "Ball" seats is used in a similar manner. Moreover, as used herein, the term "bore" is only used to indicate that a passage exists and does not imply that the passage necessarily was formed by a boring process or that the passage is axially aligned with the well bore or tool.

While this invention has been disclosed and discussed primarily in terms of specific embodiments thereof, it is not intended to be limited thereto. Other modifications and embodiments will be apparent to the worker in the art.

What is claimed is:

1. A plug apparatus, comprising:

(a) a wedge fabricated from a non-metallic composite and comprising:

i) an axial wedge bore, ii) a seat defined in said wedge bore adapted to receive a ball, and iii) a tapered outer surface, said tapered outer surface decreasing in diameter from the upper extent of said tapered outer surface toward the lower extent of said tapered outer surface;

(b) a sealing ring received around said tapered outer surface of said wedge, said sealing ring having an axial ring bore and being radially expandable; and (c) a slip fabricated from a non-metallic composite material and comprising an axial slip bore, said slip bore:

i) providing said slip with a tapered inner surface, said tapered inner surface decreasing in diameter from the upper extent of said tapered inner surface toward the lower extent of said tapered inner surface, and ii) being adapted to receive said wedge along said tapered outer surface of said wedge;

(d) wherein said wedge is adapted for displacement from an unset position generally above said slip to a set position wherein said wedge is received in said slip bore along said tapered outer surface of said wedge.

2. The plug apparatus of claim 1, wherein said sealing ring includes:

(a) an annular ring body comprising:

i) a tapered ring bore complementary to said tapered outer surface of said wedge, ii) an annular inner groove defined in said ring bore, and iii) an annular outer groove defined in the outer surface of said ring body;

(b) an inner elastomeric seal received in said inner groove; and (c) an outer elastomeric seal received in said outer groove.

3. The plug apparatus of claim 1, wherein said sealing ring and said slip are adapted to expand radially from an unset condition, in which said sealing ring and said slip have nominal outer diameters, to a set condition, in which said sealing ring and said slip have enlarged outer diameters, as said wedge is displaced from its said unset position to its said set position.

4. The plug apparatus of claim 3, wherein said sealing ring includes an annular ring body constructed of a sufficiently ductile material such that said ring body can expand radially to its said set condition without breaking.

5. The plug apparatus of claim 1, wherein said sealing ring is fabricated from a plastically deformable plastic.

6. The plug apparatus of claim 5, wherein said sealing ring is fabricated from plastically deformable plastics selected from the group consisting of polycarbonates, polyamides, polyether ether ketones, and polyetherimides and copolymers and mixtures thereof.

7. The plug apparatus of claim 1, wherein said annular ring body is fabricated from a plastically deformable plastic and has an elongation factor of at least about 10%.

8. The plug apparatus of claim 1, wherein said ball seat is located in said wedge bore such that when said wedge is in its said set position said ball seat is situated axially proximate to said sealing ring.

9. The plug apparatus of claim 1, wherein said ball seat is located in said wedge bore axially below the upper end of said wedge bore.

10. The plug apparatus of claim 1, wherein said ball seat is located in said wedge bore such that when said wedge is in its said set position said ball seat is situated axially between the upper end of said sealing ring and the lower end of said slip.

11. The plug apparatus of claim 1, wherein said ball seat is located in said wedge bore such that when said wedge is in its said set position said ball seat is situated axially below the midpoint of said slip bore.

12. The plug apparatus of claim 1, wherein said ball seat is provided by an upward facing tapered reduction in the diameter of said wedge bore.

13. The plug apparatus of claim 12, wherein said tapered reduction in diameter is approximately 15° off center.

14. The plug apparatus of claim 1, wherein said tapered outer surface of said wedge is a truncated, inverted cone and said tapered inner surface of said slip is a truncated, inverted cone.

15. The plug apparatus of claim 14, wherein said tapered outer surface of said wedge and said tapered inner surface of said slip are provided with a taper from about 1° to about 10° off center.

16. The plug apparatus of claim 14, wherein said tapered outer surface of said wedge and said tapered inner surface of said slip provide a self-locking taper fit between said wedge and said slip.

17. The plug apparatus of claim 1, wherein said slip comprises a plurality of separate slip segments, each said slip segment configured generally as lateral segments of an open cylinder.

18. The plug apparatus of claim 17, wherein said slip segments are aligned axially and, when said wedge is in its said unset position, circumferentially abut along their sides, said slip segments thereby providing a substantially continuous said inner tapered surface of said slip.

19. The plug apparatus of claim 1, wherein the upper end of said slip, when said wedge is in its said unset position, abuts said sealing ring substantially continuously about the lower end of said sealing ring.

20. The plug apparatus of claim 1, wherein said slip and said wedge are fabricated from a wound fiberglass or carbon fiber resinous material.

21. The plug apparatus of claim 1, wherein the outer surface of said slip is provided with means for enhancing engagement and gripping of a tubular wall.

22. The plug apparatus of claim 21, wherein said means are buttons fabricated of a ceramic material, heat treated steel, or a carbide.

23. A plug apparatus, comprising:

(a) a wedge comprising:

i) an axial wedge bore, and ii) a tapered outer surface, said tapered outer surface decreasing in diameter from the upper extent of said tapered outer surface toward the lower extent of said tapered outer surface;

(b) a plastically deformable plastic sealing ring received around said tapered outer surface of said wedge, said sealing ring having an axial ring bore and being radially expandable; and (c) a slip comprising an axial slip bore, said slip bore:

i) providing said slip with a tapered inner surface, said tapered inner surface decreasing in diameter from the upper extent of said tapered inner surface toward the lower extent of said tapered inner surface, and ii) being adapted to receive said wedge along said tapered outer surface of said wedge;

(d) wherein said wedge is adapted for displacement from an unset position generally above said slip to a set position wherein said wedge is received in said slip bore along said tapered outer surface of said wedge; and (e) wherein said displacement of said wedge is adapted to radially expand said sealing ring into sealing engagement with a liner without breaking said sealing ring.

24. The plug apparatus of claim 23, wherein said sealing ring is fabricated from plastically deformable plastics selected from the group consisting of polycarbonates, polyamides, polyether ether ketones, and polyetherimides and copolymers and mixtures thereof.

25. The plug apparatus of claim 23, wherein said slip comprises:

(a) a plurality of separate slip segments configured generally as lateral segments of an open cylinder;

(b) wherein said slips segments are aligned axially and, when said wedge is in its said unset position, circumferentially abut along their sides;

(c) said slip segments thereby providing a substantially continuous said inner tapered surface of said slip.

26. The plug apparatus of claim 23, wherein the upper end of said slip abuts said sealing ring about the lower end of said sealing ring as said wedge moves from its said unset position to its said set position.

27. The plug apparatus of claim 23, wherein the upper end of said slip, when said wedge is in its said unset position, abuts said sealing ring substantially continuously about the lower end of said sealing ring.

28. A plug apparatus, comprising:

(a) a wedge comprising:

i) an axial wedge bore, ii) a tapered outer surface, said tapered outer surface decreasing in diameter from the upper extent of said tapered outer surface toward the lower extent of said tapered outer surface, and iii) a plurality of collet fingers;

(b) a sealing ring received around said tapered outer surface of said wedge, said sealing ring having an axial ring bore and being radially expandable; and (c) a slip comprising an axial slip bore, said slip bore;

i) providing said slip with a tapered inner surface, said tapered inner surface decreasing in diameter from the upper extent of said tapered inner surface toward the lower extent of said tapered inner surface, and ii) being adapted to receive said wedge along said tapered outer surface of said wedge;

(d) wherein said wedge is adapted for displacement from an unset position generally above said slip to a set position wherein said wedge is received in said slip bore along said tapered outer surface of said wedge;

(e) wherein said collet fingers:

i) extend axially below said tapered outer surface of said wedge;

ii) are circumferentially spaced to form axial slots between said collet fingers, and iii) extend through said slip bore to a distal end beyond said slip when said wedge is in said unset position; and (f) wherein said displacement of said wedge is adapted to radially expand said sealing ring into sealing engagement with a liner without breaking said sealing ring.

29. The plug apparatus of claim 28, further comprising a setting ring slidably mounted around said collet fingers between said slip and said distal end of said collet fingers, said setting ring having:

(a) an outer diameter;

(b) a first radial thickness; and (c) one or more keys that protrude radially inward from said first radial thickness to a second radial thickness and into one or more of said slots between said collet fingers.

30. The plug apparatus of claim 29, further comprising:

(a) a gauge ring connected to said distal end of said collet fingers and having an outer diameter equal to or greater than said outer diameter of said setting ring.

31. The plug apparatus of claim 30, wherein:

(a) said setting ring is between said slip and a lower portion of said gauge ring; and (b) said gauge ring includes a peripheral annular wall that extends axially upward around said setting ring and at least of portion of said slip.

32. A method of setting a plug in a liner bore, said method comprising:

(a) running said plug into said liner to a location to be plugged, wherein said plug is in an unset state in which:

i) a tapered outer surface of a non-metallic composite wedge is generally above a tapered inner bore of a non-metallic composite slip, and ii) a sealing ring is received around said tapered outer surface of said wedge above said slip; and (b) setting said plug in said liner by forcing said wedge axially into said slip bore and said sealing ring, thereby;

i) radially expanding said slip to anchor said plug in said liner; and ii) radially expanding said sealing ring to seal between said plug and said liner.

33. The method of claim 32, wherein said sealing ring expands radially without breaking.

34. The method of claim 32, wherein said slip abuts said sealing ring as said wedge is forced into said slip bore and sealing ring.

35. The method of claim 32, wherein said slip, when said plug is in its said unset state, abuts said sealing ring substantially continuously about said sealing ring.

36. The method of claim 32, wherein after step (b) a ball is deployed onto an annular seat defined in an axial bore of said wedge to occlude said axial bore.

37. A plug apparatus, comprising:

(a) a wedge comprising:

i) an axial wedge bore, ii) a seat defined in said wedge bore adapted to receive a ball, and iii) a tapered outer surface, said tapered outer surface decreasing in diameter from the upper extent of said tapered outer surface toward the lower extent of said tapered outer surface;

(b) a sealing ring received around said tapered outer surface of said wedge, said sealing ring being radially expandable and comprising:

i) an annular ring body comprising:

(1) a tapered axial ring bore complementary to said tapered outer surface of said wedge, (2) an annular inner groove defined in said ring bore, and (3) an annular outer groove defined in the outer surface of said ring body;

ii) an inner elastomeric seal received in said inner groove; and iii) an outer elastomeric seal received in said outer groove;

(c) a slip comprising an axial slip bore, said slip bore:

i) providing said slip with a tapered inner surface, said tapered inner surface decreasing in diameter from the upper extent of said tapered inner surface toward the lower extent of said tapered inner surface, and ii) being adapted to receive said wedge along said tapered outer surface of said wedge;

(d) wherein said wedge is adapted for displacement from an unset position generally above said slip to a set position wherein said wedge is received in said slip bore along said tapered outer surface of said wedge.

38. The plug apparatus of claim 25, wherein said ring body is fabricated from a plastically deformable plastic.

* * * * *